US008501675B2

(12) United States Patent
Haigh et al.

(10) Patent No.: US 8,501,675 B2
(45) Date of Patent: Aug. 6, 2013

(54) HIGH VISCOSITY NOVEL BASE STOCK LUBRICANT VISCOSITY BLENDS

(75) Inventors: Heather M. Haigh, Burke, VA (US); James T. Carey, Medford, NJ (US); Angela S. Galiano-Roth, Mullica Hill, NJ (US); Margaret M. Wu, Skillman, NJ (US); Andrea B. Wardlow, Cherry Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 12/913,453

(22) Filed: Oct. 27, 2010

(65) Prior Publication Data

US 2011/0136714 A1 Jun. 9, 2011

Related U.S. Application Data

(63) Continuation of application No. 12/075,391, filed on Mar. 11, 2008, now abandoned.

(51) Int. Cl.
*C10M 143/00* (2006.01)
*C10M 105/10* (2006.01)

(52) U.S. Cl.
USPC ..... 508/583; 508/591

(58) Field of Classification Search
USPC ..... 585/517, 10, 12; 526/160; 508/591, 508/280, 583
See application file for complete search history.

(56) References Cited

U.S. PATENT DOCUMENTS

| | | | |
|---|---|---|---|
| 2,978,442 | A | 4/1961 | Brightbill et al. |
| 3,149,178 | A | 9/1964 | Hamilton et al. |
| 3,164,578 | A | 1/1965 | Baker et al. |
| 3,382,291 | A | 5/1968 | Brennan |
| 3,576,923 | A | 4/1971 | Randell et al. |
| 3,742,082 | A | 6/1973 | Brennan |
| 3,769,363 | A | 10/1973 | Brennan |
| 3,780,128 | A | 12/1973 | Shubkin |
| 3,876,720 | A | 4/1975 | Heilman et al. |
| 3,883,417 | A | 5/1975 | Woo et al. |
| 4,016,349 | A | 4/1977 | McKenna |

(Continued)

FOREIGN PATENT DOCUMENTS

| | | |
|---|---|---|
| DE | 19827323 | 6/1998 |
| EP | 0088453 B1 | 5/1987 |

(Continued)

OTHER PUBLICATIONS

J. Brennan, "Wide-Temperature Range Synthetic Hydrocarbon Fluids", Ind. Eng. Chem. Prod. Res. Dev., 1980, vol. 19, pp. 2-6.

(Continued)

*Primary Examiner* — James Goloboy
*Assistant Examiner* — Chantel Graham
(74) *Attorney, Agent, or Firm* — Robert A. Migliorini

(57) ABSTRACT

A lubricant formulation and method of blending a lubricant formulation is disclosed. The lubricant formulation comprises at least two base stocks. The first base stock comprises a viscosity greater than 135 cSt, Kv100° C. and a tight molecular weight distribution as a function of viscosity. The second base stock comprises a viscosity less than 60 cSt, Kv100° C. The formulation also comprises a polyol ester. The lubricant formulation provides favorable properties.

16 Claims, 6 Drawing Sheets

U.S. PATENT DOCUMENTS 4,132,663 A 1/1979 Heilman et al.
4,172,855 A 10/1979 Shubkin et al.
4,234,435 A 11/1980 Meinhardt et al.
4,239,930 A 12/1980 Allphin et al.
4,263,150 A 4/1981 Clason et al.
4,263,465 A 4/1981 Sheng et al.
4,289,635 A 9/1981 Schroeck
4,308,154 A 12/1981 Clason et al.
4,367,352 A 1/1983 Watts, Jr. et al.
4,413,156 A 11/1983 Watts, Jr. et al.
4,417,990 A 11/1983 Clason et al.
4,434,308 A 2/1984 Larkin et al.
4,451,684 A 5/1984 Pasky
4,469,912 A 9/1984 Blewett et al.
4,587,368 A 5/1986 Pratt
4,652,416 A 3/1987 Millot
4,701,489 A 10/1987 Hughes et al.
4,704,491 A 11/1987 Tsutsui et al.
4,776,967 A 10/1988 Ichihashi et al.
4,892,851 A 1/1990 Ewen et al.
4,906,799 A 3/1990 Forbus, Jr. et al.
4,910,355 A 3/1990 Shubkin et al.
4,914,254 A 4/1990 Pelrine
4,922,046 A 5/1990 Kinoshita et al.
4,926,004 A 5/1990 Pelrine et al.
4,943,383 A 7/1990 Avery et al.
4,950,822 A 8/1990 Dileo et al.
4,962,249 A 10/1990 Chen et al.
4,962,262 A 10/1990 Winter et al.
4,967,032 A 10/1990 Ho et al.
4,990,709 A 2/1991 Wu
5,012,020 A 4/1991 Jackson et al.
5,017,299 A 5/1991 Gutierrez et al.
5,017,714 A 5/1991 Welborn, Jr.
5,057,235 A 10/1991 Farng et al.
5,068,487 A 11/1991 Theriot
5,087,788 A 2/1992 Wu
5,104,579 A 4/1992 Benjamin et al.
5,113,030 A 5/1992 Chen et al.
5,132,478 A 7/1992 Ho et al.
5,146,021 A 9/1992 Jackson et al.
5,157,177 A 10/1992 Pelrine et al.
5,177,276 A 1/1993 Beach et al.
5,186,851 A 2/1993 Gutierrez et al.
5,187,250 A 2/1993 Asanuma et al.
5,188,724 A 2/1993 Heilman et al.
5,208,403 A 5/1993 Buchanan et al.
5,220,100 A 6/1993 Massie et al.
5,243,114 A 9/1993 Johnson et al.
5,254,274 A 10/1993 Ho et al.
5,264,642 A 11/1993 Wu
5,276,227 A 1/1994 Wu et al.
5,276,277 A 1/1994 Hightower et al.
5,369,196 A 11/1994 Matsumoto et al.
5,382,739 A 1/1995 Atkins et al.
5,462,995 A 10/1995 Hosaka et al.
5,498,815 A 3/1996 Schaerfl, Jr. et al.
5,602,086 A 2/1997 Le et al.
5,679,812 A 10/1997 Winter et al.
5,688,887 A 11/1997 Bagheri et al.
5,705,577 A 1/1998 Rossi et al.
5,731,254 A 3/1998 Winter et al.
5,807,949 A 9/1998 Rossi et al.
5,811,379 A 9/1998 Rossi et al.
5,846,896 A 12/1998 Ewen
5,852,143 A 12/1998 Sishta et al.
5,859,159 A 1/1999 Rossi et al.
6,043,401 A 3/2000 Bagheri et al.
6,080,301 A 6/2000 Berlowitz et al.
6,087,307 A 7/2000 Kaminski et al.
6,090,989 A 7/2000 Trewella et al.
6,133,209 A 10/2000 Rath et al.
6,147,271 A 11/2000 Strebel et al.
6,165,949 A 12/2000 Berlowitz et al.
6,180,575 B1 1/2001 Nipe
6,388,032 B1 5/2002 Yamaura et al.
6,395,948 B1 5/2002 Hope et al.
6,414,090 B2 7/2002 Minami et al.
6,436,881 B1 * 8/2002 McHenry et al. ..... 508/280
6,479,722 B1 11/2002 De Wet et al.
6,548,723 B2 4/2003 Bagheri et al.
6,548,724 B2 4/2003 Bagheri et al.
6,642,169 B2 11/2003 Weatherhead
6,646,174 B2 11/2003 Clarembeau
6,706,828 B2 3/2004 DiMaio
6,824,671 B2 11/2004 Goze et al.
6,858,767 B1 2/2005 DiMaio et al.
6,869,917 B2 3/2005 Deckman et al.
7,022,784 B2 4/2006 Wu et al.
7,060,768 B2 6/2006 Brookhart et al.
7,129,197 B2 10/2006 Song et al.
7,312,185 B2 12/2007 Willey et al.
7,544,850 B2 6/2009 Goze et al.
7,547,811 B2 6/2009 Kramer et al.
7,585,823 B2 9/2009 Sullivan et al.
7,592,411 B2 9/2009 Wu et al.
7,592,497 B2 9/2009 Yang et al.
7,683,013 B2 3/2010 Carey et al.
7,795,194 B2 9/2010 Iimura et al.
2001/0041817 A1 * 11/2001 Bagheri et al. ..... 585/517
2001/0041818 A1 11/2001 Bagheri et al.
2003/0055184 A1 * 3/2003 Song et al. ..... 526/160
2003/0236177 A1 12/2003 Wu et al.
2004/0033908 A1 2/2004 Deckman et al.
2004/0087746 A1 5/2004 Razavi
2004/0092408 A1 5/2004 Willey et al.
2004/0097772 A1 5/2004 Deckers et al.
2004/0147693 A1 7/2004 DiMaio
2004/0220359 A1 11/2004 Abhari et al.
2004/0225088 A1 11/2004 Vaughan et al.
2004/0230016 A1 11/2004 Blackborow et al.
2005/0059563 A1 3/2005 Sullivan et al.
2005/0101761 A1 5/2005 Lambert et al.
2005/0183988 A1 8/2005 Freerks et al.
2006/0157383 A1 7/2006 Wu et al.
2007/0000807 A1 1/2007 Wu et al.
2007/0043248 A1 2/2007 Wu et al.
2007/0208151 A1 9/2007 Okada et al.
2007/0289897 A1 12/2007 Carey et al.
2008/0020954 A1 1/2008 Haigh et al.
2008/0177121 A1 7/2008 Wu et al.
2009/0005279 A1 1/2009 Wu et al.
2009/0036725 A1 2/2009 Wu et al.
2009/0093657 A1 4/2009 Buchanan et al.
2009/0156874 A1 6/2009 Patil et al.
2009/0240012 A1 9/2009 Patil et al.
2010/0006259 A1 1/2010 Mori et al.
2010/0105589 A1 4/2010 Lee et al.
2010/0256026 A1 10/2010 Wu et al.
2010/0292424 A1 11/2010 Wu et al.
2011/0082063 A1 4/2011 Carey et al.
2011/0136714 A1 6/2011 Haigh et al.

FOREIGN PATENT DOCUMENTS

EP 0276320 B1 8/1988
EP 0277004 A1 8/1988
EP 0277007 B1 8/1988
EP 0284708 B1 10/1988
EP 0291006 B1 11/1988
EP 0321852 B1 6/1989
EP 0349276 B1 1/1990
EP 0377306 B1 7/1990
EP 0403866 A1 12/1990
EP 0513380 B1 11/1992
EP 0680942 A1 5/1994
EP 0613873 A2 9/1994
EP 0930320 A1 7/1997
EP 1028128 A1 10/1997
EP 0992517 A2 9/1998
EP 1309633 B1 8/2000
EP 1342707 A2 9/2003
EP 1607415 A1 12/2005
EP 1661921 5/2006
GB 938069 9/1963
IN 191553 12/2003
JP 6336590 A 12/1994
JP 200500446 A 7/2005

| | | | | |
|---|---|---|---|---|
| WO | 199623751 | | | 8/1996 |
| WO | 9967347 | | | 6/1999 |
| WO | 0214384 | | | 2/2002 |
| WO | 03009136 | A1 | | 1/2003 |
| WO | 03020856 | A1 | | 3/2003 |
| WO | 03051943 | A1 | | 6/2003 |
| WO | 03071369 | A1 | | 8/2003 |
| WO | 03104292 | A1 | | 12/2003 |
| WO | 2004046214 | A2 | | 6/2004 |
| WO | 2004053030 | A2 | | 6/2004 |
| WO | WO2004053030 | | * | 6/2004 |
| WO | 2007005094 | A1 | | 1/2007 |
| WO | 2007011462 | A1 | | 1/2007 |
| WO | 2007011832 | A1 | | 1/2007 |
| WO | 2007145924 | A1 | | 12/2007 |
| WO | 2007146081 | A1 | | 12/2007 |
| WO | 2008010865 | A2 | | 1/2008 |
| WO | 2009017953 | A2 | | 2/2009 |
| WO | 2009123800 | A1 | | 10/2009 |
| WO | 2009137264 | A1 | | 11/2009 |

OTHER PUBLICATIONS

K. Denbigh, "The Kinetics of Continuous Reaction Processes: Application to Polymerization", J. Applied Chem, 1951, vol. 1, pp. 227-236.

K. Denbigh, "Continuous Reactions: Part II. The Kinetics of Steady State Polymerisation", Trans Faraday Soc., 1947, vol. 43, pp. 648-660.

A. Munoz-Escalona, et al., "Single-Site Supported Catalysts for Ethylene Polymerization", Metallocene Tech., 1999, pp. 2242-2246.

Z. Fan, et al., "Effect of Ethoxy- and Methoxysilane Donors in Propene/1-Hexene Copolymerization with High-Yield Supported Ziegler-Natta Catalysts", Macromolecular Chemistry and Physics, 1994, vol. 195, pp. 3889-3899.

G. Gokel, ed., "Dean's Handbook of Organic Chemistry", 2nd Edition, McGraw-Hill, 2004, available on-line at hhtp://knovel.com.

M. LeVan, et al., "Adsorption and Ion Exchange", Perry's Chemical Engineer's Handbook, 7th ed., 1997, pp. 16-1-16-66.

O. Levenspiel, "Ch. 7: Design for Multiple Reactions", Chemical Reaction Engineering, 2nd ed., 1972, pp. 196-209.

N. Naga, et al., "Effect of Co-Catalyst System on a-Olefin Polymerization with Rac- and Meso-[Dimethylsilylenebis (2,3,5-Trimethyl-Cyclopentadienyl)] Zirconium Dichloride", Macromol. Rapid Commun., 1997, vol. 18, pp. 581-589.

N. Naga, et al., "Polymerization Behavior of a-Olefins with Rac- and Meso-Type Ansa-Metallocene Catalyst: Effects of Cocatalyst and Metallocene Ligand", Macromolecular Chemistry Physics, 1999, vol. 200, pp. 1587-1594.

F. Rodriguez, "The Molecular Weight of Polymers", Principles of Polymer Systems, 1970, Chapter 6, pp. 115-144.

M. Sacchi, et al., "Use of Different Alkoxysilanes as External Donors in MgCl2-Supported Ziegler-Natta Catalysts to Obtain Propene/1-Butene Copolymers with Different Microstructure", Macromolecular Chemistry and Physics, 1994, vol. 195, pp. 2805-2816.

T. Seraidaris, et al., "High-Molar-Mass Polypropene with Tunable Elastic Properties by Hafnocene/Borate Catalysts", Journal of Polymer Science: Part A: Polymer Chemistry, 2006, vol. 44, pp. 4743-4751.

J. Wills, "Synthetic Lubricants", Lubrication Fundamentals, Marcel Dekker Inc., New York, 1980, pp. 75-80.

"Mobil Releases SuperSyn PAO's", Lubrication Engineers, 1999, vol. 55, Part 8, pp. 45.

TIBA data, "TIBA datasheet" available on-line at www.albermarle.com on Aug. 26, 2010.

ASTM 03427-03, "Standard Test Method for Air Release Properties of Petroleum Oils", Oct. 2002.

http://www.mobil.com/USA, Mobilgear®SHC XMP Series, Jun. 2, 2005.

http://www.famm11c.com/famm/lubricant_product.asp?gearoils&&wPinnacleMarineGear220, Pinnacle® Marine Gear 220, 2004.

* cited by examiner

HIGH VISCOSITY NOVEL BASE STOCK LUBRICANT VISCOSITY BLENDS

This application is a Continuation-in-Part of U.S. Ser. No. 12/075,391 filed Mar. 11, 2008 which claims the benefit of U.S. Ser. No. 11/810,925 filed Jun. 6, 2007 which claims the benefit of U.S. Ser. No. 11/810,019 filed Jun. 4, 2007 which claims the benefit of U.S. Ser. No. 60/811,207 filed Jun. 6, 2006.

BACKGROUND

Oil operating temperature and efficiencies are very important to the designers, builders, and user of equipment which employ worm gearing. On a relative basis, a higher percentage efficiency rating for a lubricant results in more power or torque being transmitted through a subject gearbox. Since more power is being transferred through a piece of equipment using a more efficient lubricant, less power is being wasted to friction or heat. It is desirable for a lubricant to be optimized for maximum power throughput and to therefore allow for lower operating temperatures. Lower operating temperatures in gearboxes give rise to several benefits which include: lower energy consumption, longer machine life, and longer seal life. Seal failures are one of the principle reasons for repair and down-time in rotating equipment. A decrease of 10 degrees Celsius of operating temperature can double seal life and therefore decrease overall costs of operation and ownership.

A Small Worm Gear Rig measures both dynamic operating temperature and efficiency of power throughput simultaneously. In this gear rig, a splash lubricated bronze on steel worm gear set is the gearbox design employed. The subject worm drive gearbox, 1.75 inch centerline distance, 20:1 reduction ratio, was mounted in an L-shaped test rig with high precision torque meters on both the input and output shafts of the gearbox to measure power throughput efficiency performance based on control of output torque. The output torque was controlled to 100% of the rated load with a service factor of 1.0. Also, gearbox sump oil temperature was carefully monitored during operation using four thermocouples. National Basic Sensor located at 4921 Carver Avenue in Trevose, Pa. sells J-type thermocouples that are suitable for this rig test.

All torque and temperature data was logged every 10 seconds for a period of 12 hours after thermal stability was attained. The efficiency was calculated by establishing the ratio of output torque to input torque. The resulting efficiency (%) and operational temperatures (F.°) were compared for experimental blends to that of reference oils.

In addition to temperature & efficiency, air entrainment is another issue in lubricating oils. All lubricating oil systems contain some air. It can be found in four phases: free air, dissolved air, entrained air and foam. Free air is trapped in a system, such as an air pocket in a hydraulic line. Dissolved air is in solution with the oil and is not visible to the naked eye. Foam is a collection of closely packed bubbles surrounded by thin films of oil that collect on the surface of the oil.

Air entrainment is a small amount of air in the form of extremely small bubbles (generally less than 1 mm in diameter) dispersed throughout the bulk of the oil. Agitation of lubricating oil with air in equipment, such as bearings, couplings, gears, pumps, and oil return lines, may produce a dispersion of finely divided air bubbles in the oil. If the residence time in the reservoir is too short to allow the air bubbles to rise to the oil surface, a mixture of air and oil will circulate through the lubricating oil system. This may result in an inability to maintain oil pressure (particularly with centrifugal pumps), incomplete oil films in bearings and gears, and poor hydraulic system performance or failure. Air entrainment is treated differently than foam, and is most often a completely separate problem. A partial list of potential effects of air entrainment include: pump cavitation, spongy, erratic operation of hydraulics, loss of precision control, vibrations, oil oxidation, component wear due to reduced lubricant viscosity, equipment shut down when low oil pressure switches trip, "micro-dieseling" due to ignition of the bubble sheath at the high temperatures generated by compressed air bubbles, safety problems in turbines if overspeed devices do not react quickly enough, and loss of head in centrifugal pumps.

Antifoamants, including silicone additives help produce smaller bubbles in the bulk of the oil. In stagnant systems, the combination of smaller bubbles and greater sheath density can cause serious air entrainment problems. Turbine oil systems with quiescent reservoirs of several thousand gallons may have air entrainment problems with as little as a half a part per million silicone.

One widely used method to test air release properties of petroleum oils is ASTM D3427-03. This test method measures the time for the entrained air content to fall to the relatively low value of 0.2% under a standardized set of test conditions and hence permits the comparison of the ability of oils to separate entrained air under conditions where a separation time is available. The significance of this test method has not been fully established. However, entrained air can cause sponginess and lack of sensitivity of the control of turbine and hydraulic systems. This test may not be suitable for ranking oils in applications where residence times are short and gas contents are high.

In the ASTM D3427 method, compressed air is blown through the test oil, which has been heated to a temperature of 25, 50, or 75° C. After the air flow is stopped, the time required for the air entrained in the oil to reduce in volume to 0.2% is usually recorded as the air release time.

In addition, there is a need for low temperature air release properties. Today, approximately, 80 percent of the gas turbines in North America operate in a cyclical mode or regular stop-start operation versus continuous base operation. Turbine oil with superior air release enables smooth fast starts by eliminating the potential for cavitations in the turbine hydraulic circuit. Turbines and compressor machinery are being designed to have a smaller equipment footprint for lower hardware and infrastructure costs. Consequently, units will operate at higher flow rates and with shorter residence times, demanding oils with improved air release. Air entrainment may accelerate oil degradation due to micro dieseling (adaptation compression) and/or oxidation mechanisms.

Due to the high energy prices, the energy and power industries are building facilities in more remote places including colder climates, such as Russia, which were previously not commercially attractive. Superior low temperature fluidity, pumpability and air release lubricant properties are advantageous for these applications.

Accordingly, there is a need for a lubricant that provides a consistent favorable operating temperature and power efficiency along with air release properties (including low temperatures) using high viscosity base stock blends. The present invention satisfies this need by providing a novel combination of base stocks that give the desired performance.

SUMMARY

A novel lubricant formulation is disclosed. In one embodiment the novel lubricant formulation comprises at least two base stocks The first base stock is a metallocene catalyzed PAO (poly-alpha-olefins) with a viscosity greater than 135 cSt, Kv100° C. having a molecular weight distribution (MWD) as a function of viscosity at least 10 percent less than the algorithm: MWD=0.2223+1.0232*log (Kv at 100° C. in cSt). The second base stock is lubricating oil with a viscosity of less than 100 cSt, Kv100° C.

In a second embodiment, the novel lubricant formulation comprises at least two base stocks. A first base stock comprising a metallocene catalyzed PAO with a viscosity greater than 135 cSt, Kv100° C. and a second base stock comprising an oil with a viscosity less than 60 cSt, Kv100° C.

A method for blending a novel formulation is also disclosed. The method comprises obtaining a first synthetic base stock lubricant. The first base stock having a molecular weight distribution (MWD) as a function of viscosity at least 10 percent less than the algorithm: MWD=0.2223+1.0232*log (Kv at 100° C. in cSt). A second base stock lubricant is obtained. The second base stock lubricant has a viscosity less than 100 cSt, Kv100° C. The first and second base stock lubricants are mixed to produce the lubricating oil.

DETAILED DESCRIPTION

Figure 1:
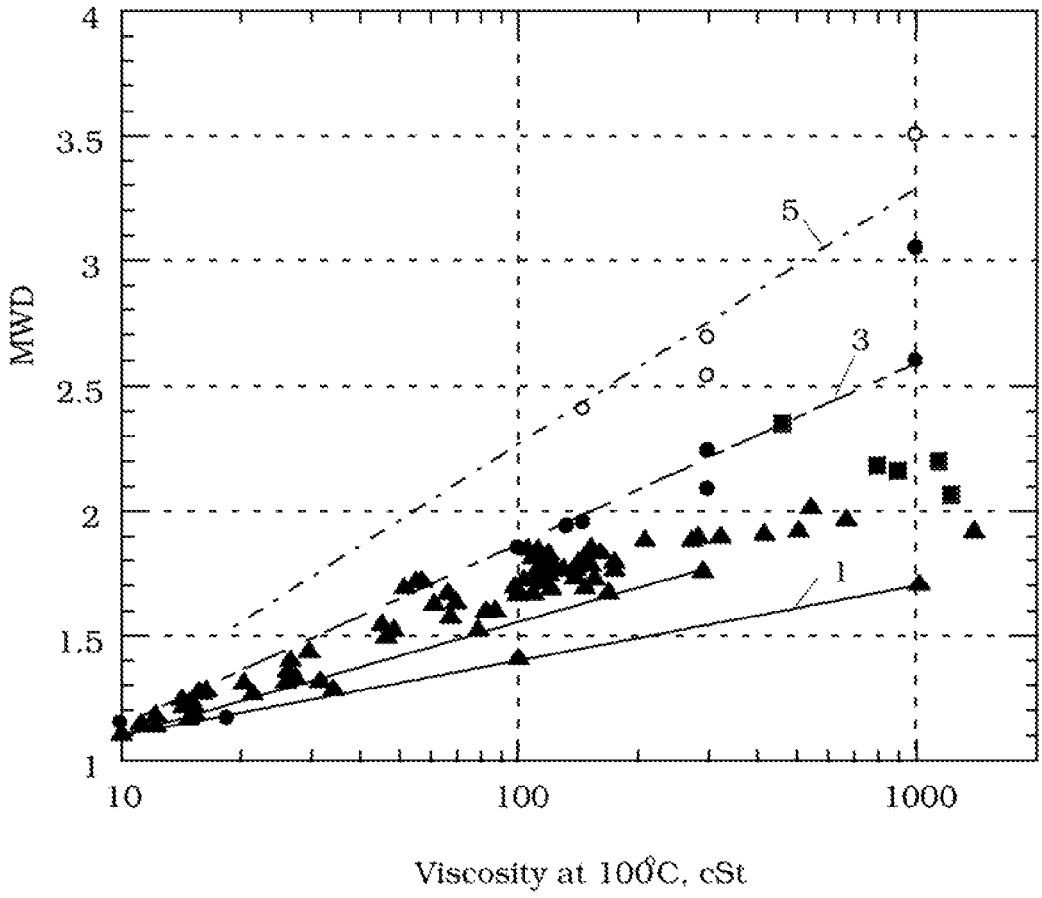
FIG. 1 is a graph illustrating the molecular weight distribution of High viscosities PAO.

In this patent, unless specified otherwise, all base stock viscosities are referred to their 100° C. kinematic viscosity in cSt as measured by ASTD D445 method. The ISO viscosity classification which is typically cited for industrial lubes of finished lubricants based on viscosities observed at 40° C. We have discovered novel combinations of base stocks that provide unexpected favorable improvements in lubricating properties. In various embodiments these properties include favorable improvements in shear stability, air release, pour point, temperature control, viscosity loss and energy efficiency. In U.S. Provisional Application No. 60/811,273, we have discovered a novel combination of base stocks that provides an unexpected increase in aeration properties, shear stability and energy efficiency. In U.S. Provisional Application No. 60/811,207, we have discovered the benefits of using metallocene catalyzed PAO compared to the prior art PAO.

In one embodiment, this novel discovery is based on wide "bi-modal" and "extreme-modal" blends of oil viscosities which are base stock viscosity differences of at least 90 cSt, preferably at least 95 cSt, and possibly greater than 100 cSt, respectively wherein the high viscosity is at least 135 cSt, and the low viscosity base stock is less than 60 cSt. Kinematic Viscosity is determined by ASTM D-445 method by measuring the time for a volume of liquid to flow under gravity through a calibrated glass capillary viscometer. Viscosity is typically measured in centistokes (cSt, or $mm^2/s$) units. The ISO viscosity classification which is typically cited for industrial lubes of finished lubricants based on viscosities observed at 40° C. Base stock oils used to blend finished oils, are generally described using viscosities observed at 100° C.

This "bi-modal" blend of viscosities also provides a temperature benefit by lowering the lubricant temperature in gear testing by approximately 10° C. This temperature drop would provide increased efficiency boosts and extended seal life.

In the past high viscosity base stocks have not been practical from some applications due to shear stability problems resulting in viscosity loss in service due to breakdown of polymeric chains We have discovered that new base stocks with low with narrow molecular weight distributions provide excellent shear stability. This discovery provided the ability to utilize high viscosity base stocks in what can be described as "dumbbell", "bi-modal" and "extreme-modal" blends.

In a preferred embodiment, the new base stocks are produced according to the method described in U.S. Provisional Application Nos. 60/650,206. These base stocks are known as metallocene catalyzed bases stocks and are described in detail below.

Metallocene Base Stocks

In one embodiment, the metallocene catalyzed PAO (or mPAO) used for this invention can be a co-polymer made from at least two alpha-olefins or more, or a homo-polymer made from a single alpha-olefin feed by a metallocene catalyst system.

This copolymer mPAO composition is made from at least two alpha-olefins of C3 to C30 range and having monomers randomly distributed in the polymers. It is preferred that the average carbon number is at least 4.1. Advantageously, ethylene and propylene, if present in the feed, are present in the amount of less than 50 wt % individually or preferably less than 50 wt % combined. The copolymers of the invention can be isotactic, atactic, syndiotactic polymers or any other form of appropriate tacticity. These copolymers have useful lubricant properties including excellent VI, pour point, low temperature viscometrics by themselves or as blend fluid with other lubricants or other polymers. Furthermore, these copolymers have narrow molecular weight distributions and excellent lubricating properties.

In an embodiment, mPAO is made from the mixed feed LAOs comprising at least two and up to 26 different linear alpha-olefins selected from C3 to C30 linear alpha-olefins. In a preferred embodiment, the mixed feed LAO is obtained from an ethylene growth process using an aluminum catalyst or a metallocene catalyst. The growth olefins comprise mostly C6 to C18-LAO. LAOs from other process, such as the SHOP process, can also be used.

This homo-polymer mPAO composition is made from single alpha-olefin choosing from C3 to C30 range, preferably C3 to C16, most preferably C3 to C14 or C3 to C12. The homo-polymers of the invention can be isotactic, atactic, syndiotactic polymers or any combination of these tacticity or other form of appropriate tacticity. Often the tacticity can be carefully tailored by the polymerization catalyst and polymerization reaction condition chosen or by the hydrogenation condition chosen. These homo-polymers have useful lubricant properties including excellent VI, pour point, low temperature viscometrics by themselves or as blend fluid with other lubricants or other polymers. Furthermore, these homo-polymers have narrow molecular weight distributions and excellent lubricating properties.

In another embodiment, the alpha-olefin(s) can be chosen from any component from a conventional LAO production facility or from refinery. It can be used alone to make homopolymer or together with another LAO available from refinery or chemical plant, including propylene, 1-butene, 1-pentene, and the like, or with 1-hexene or 1-octene made from dedicated production facility. In another embodiment, the alpha-olefins can be chosen from the alpha-olefins produced from Fischer-Trosch synthesis (as reported in U.S. Pat. No. 5,382,739). For example, C3 to C16-alpha-olefins, more preferably linear alpha-olefins, are suitable to make homo-polymers. Other combinations, such as C4 and C14-LAO; C6 and C16-LAO; C8, C10, C12-LAO; or C8 and C14-LAO; C6, C10, C14-LAO; C4 and C12-LAO, etc. are suitable to make co-polymers.

The activated metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion and optionally with co-activators, typically trialkylaluminum compounds.

According to the invention, a feed comprising a mixture of LAOs selected from C3 to C30 LAOs or a single LAO selected from C3 to C16 LAO, is contacted with an activated metallocene catalyst under oligomerization conditions to provide a liquid product suitable for use in lubricant components or as functional fluids. This invention is also directed to a copolymer composition made from at least two alpha-olefins of C3 to C30 range and having monomers randomly distributed in the polymers. The phrase "at least two alpha-olefins" will be understood to mean "at least two different alpha-olefins" (and similarly "at least three alpha-olefins" means "at least three different alpha-olefins", and so forth).

In preferred embodiments, the average carbon number (defined hereinbelow) of said at least two alpha-olefins in said feed is at least 4.1. In another preferred embodiment, the amount of ethylene and propylene in said feed is less than 50 wt % individually or preferably less than 50 wt % combined. A still more preferred embodiment comprises a feed having both of the aforementioned preferred embodiments, i.e., a feed having an average carbon number of at least 4.1 and wherein the amount of ethylene and propylene is less than 50 wt % individually.

In embodiments, the product obtained is an essentially random liquid copolymer comprising the at least two alpha-olefins. By "essentially random" is meant that one of ordinary skill in the art would consider the products to be random copolymer. Other characterizations of randomness, some of which are preferred or more preferred, are provided herein. Likewise the term "liquid" will be understood by one of ordinary skill in the art, but more preferred characterizations of the term are provided herein. In describing the products as "comprising" a certain number of alpha-olefins (at least two different alpha-olefins), one of ordinary skill in the art in possession of the present disclosure would understand that what is being described in the polymerization (or oligomerization) product incorporating said certain number of alpha-olefin monomers. In other words, it is the product obtained by polymerizing or oligomerizing said certain number of alpha-olefin monomers.

This improved process employs a catalyst system comprising a metallocene compound (Formula 1, below) together with an activator such as a non-coordinating anion (NCA) (Formula 2, below) and optionally a co-activator such as a trialkylaluminum, or with methylaluminoxane (MAO) (Formula 3, below).

Formula 1

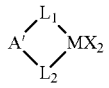

Formula 2

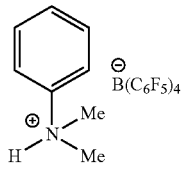

NCA

Formula 3

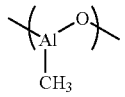

MAO

The term "catalyst system" is defined herein to mean a catalyst precursor/activator pair, such as a metallocene/activator pair. When "catalyst system" is used to describe such a pair before activation, it means the unactivated catalyst (pre-catalyst) together with an activator and, optionally, a co-activator (such as a trialkyl aluminum compound). When it is used to describe such a pair after activation, it means the activated catalyst and the activator or other charge-balancing moiety. Furthermore, this activated "catalyst system" may optionally comprise the co-activator and/or other charge-balancing moiety. Optionally and often, the co-activator, such as trialkylaluminum compound, is also used as impurity scavenger.

The metallocene is selected from one or more compounds according to Formula 1, above. In Formula 1, M is selected from Group 4 transition metals, preferably zirconium (Zr), hafnium (Hf) and titanium (Ti), L1 and L2 are independently selected from cyclopentadienyl ("Cp"), indenyl, and fluorenyl, which may be substituted or unsubstituted, and which may be partially hydrogenated, A can be no atom, as in many un-bridged metallocenes or A is an optional bridging group which if present, in preferred embodiments is selected from dialkylsilyl, dialkylmethyl, diphenylsilyl or diphenylmethyl, ethylenyl (—CH2-CH2-), alkylethylenyl (—CR2-CR2-), where alkyl can be independently C1 to C16 alkyl radical or phenyl, tolyl, xylyl radical and the like, and wherein each of the two X groups, Xa and Xb, are independently selected from halides, OR (R is an alkyl group, preferably selected from C1 to C5 straight or branched chain alkyl groups), hydrogen, C1 to C16 alkyl or aryl groups, haloalkyl, and the like. Usually relatively more highly substituted metallocenes give higher catalyst productivity and wider product viscosity ranges and are thus often more preferred.

In another embodiment, any of the polyalpha-olefins produced herein preferably have a Bromine number of 1.8 or less as measured by ASTM D 1159, preferably 1.7 or less, preferably 1.6 or less, preferably 1.5 or less, preferably 1.4 less, preferably 1.3 or less, preferably 1.2 or less, preferably 1.1 or less, preferably 1.0 or less, preferably 0.5 or less, preferably 0.1 or less.

In another embodiment, any of the polyalpha-olefins produced herein are hydrogenated and have a Bromine number of 1.8 or less as measured by ASTM D 1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less.

In another embodiment, any of the polyalpha-olefins described herein may have monomer units represented by the formula, in addition to the all regular 1,2-connection.

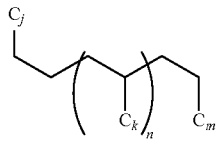

where j, k and m are each, independently, 1, 2, 3, 4, 5, 6, 7, 8, 9, 10, 11, 12, 13, 14, 15, 16, 17, 18, 19, 20, 21, or 22, n is an integer from 1 to 350 (preferably 1 to 300, preferably 5 to 50) as measured by proton NMR In another embodiment, any of the polyalpha-olefins described herein preferably have an Mw (weight average molecular weight) of 100,000 or less, preferably between 100 and 80,000, preferably between 250 and 60,000, preferably between 280 and 50,000, preferably between 336 and 40,000 g/mol.

In another embodiment, any of the polyalpha-olefins described herein preferably have an Mn (number average molecular weight) of 50,000 or less, preferably between 200 and 40,000, preferably between 250 and 30,000, preferably between 500 and 20,000 g/mole.

In another embodiment, any of the polyalpha-olefins described herein preferably have a molecular weight distribution (MWD=Mw/Mn) of greater than 1 and less than 5, preferably less than 4, preferably less than 3, preferably less than 2.5. The MWD of mPAO is always a function of fluid viscosity. Alternately any of the polyalpha-olefins described herein preferably have an Mw/Mn of between 1 and 2.5, alternately between 1 and 3.5, depending on fluid viscosity.

The Mw, Mn and Mz are measured by GPC method using a column for medium to low molecular weight polymers, tetrahydrofuran as solvent and polystyrene as calibration standard, correlated with the fluid viscosity according to a power equation.

In a preferred embodiment of this invention, any PAO described herein may have a pour point of less than 0° C. (as measured by ASTM D 97), preferably less than −10° C., preferably less than −20° C., preferably less than −25° C., preferably less than −30° C., preferably less than −35° C., preferably less than −50°, preferably between −10 and −80° C., preferably between −15° C. and −70° C.

In a preferred embodiment of this invention, any PAO described herein may have a kinematic viscosity (at 40° C. as measured by ASTM D 445) from about 4 to about 50,000 cSt, preferably from about 5 cSt to about 30,000 cSt at 40° C., alternately from about 4 to about 100,000 cSt, preferably from about 6 cSt to about 50,000 cSt, preferably from about 10 cSt to about 30,000 cSt at 40° C.

In another embodiment, any polyalpha-olefin described herein may have a kinematic viscosity at 100° C. from about 1.5 to about 5,000 cSt, preferably from about 2 to about 3,000 cSt, preferably from about 3 cSt to about 1,000 cSt, more preferably from about 4 cSt to about 1,000 cSt, and yet more preferably from about 8 cSt to about 500 cSt as measured by ASTM D445. The PAOs preferably have viscosities in the range of 2 to 500 cSt at 100° C. in one embodiment, and from 2 to 3000 cSt at 100° C. in another embodiment, and from 3.2 to 300 cSt in another embodiment. Alternately, the polyalpha-olefin has a KV100 of less than 200 cSt.

In another embodiment, any polyalpha olefin described herein may have a kinematic viscosity at 100° C. from 3 to 10 cSt and a flash point of 150° C. or more, preferably 200° C. or more (as measured by ASTM D 56).

In another embodiment, any polyalpha olefin described herein may have a dielectric constant of 2.5 or less (1 kHz at 23° C. as determined by ASTM D 924).

In another embodiment, any polyalpha olefin described herein may have a specific gravity of 0.75 to 0.96 g/cm$^3$, preferably 0.80 to 0.94 g/cm$^3$.

In another embodiment, any polyalpha olefin described herein may have a viscosity index (VI) of 100 or more, preferably 120 or more, preferably 130 or more, alternately, form 120 to 450, alternately from 100 to 400, alternately from 120 to 380, alternately from 100 to 300, alternately from 140 to 380, alternately from 180 to 306, alternately from 252 to 306, alternately the viscosity index is at least about 165, alternately at least about 187, alternately at least about 200, alternately at least about 252. For many lower viscosity fluids made from 1-decene or 1-decene equivalent feeds (KV100° C. of 3 to 10 cSt), the preferred VI range is from 100 to 180. Viscosity index is determined according to ASTM Method D 2270-93 [1998].

All kinematic viscosity values reported for fluids herein are measured at 100° C. unless otherwise noted. Dynamic viscosity can then be obtained by multiplying the measured kinematic viscosity by the density of the liquid. The units for kinematic viscosity are in mm$^2$/s, commonly converted to cSt or centistokes (1 cSt=10-6 m$^2$/s or 1 cSt=1 mm$^2$/sec).

One embodiment is a new class of poly-alpha-olefins, which have a unique chemical composition characterized by a high degree of linear branches and very regular structures with some unique head-to-head connections at the end position of the polymer chain. The polyalpha-olefins, whether homo-polymers or co-polymers, can be isotactic, syndiotactic or atactic polymers, or have combination of the tacticity. The new poly-alpha-olefins when used by themselves or blended with other fluids have unique lubrication properties.

Another embodiment is a new class of hydrogenated poly-alpha-olefins having a unique composition which is characterized by a high percentage of unique head-to-head connection at the end position of the polymer and by a reduced degree tacticity compared to the product before hydrogenation. The new poly-alpha-olefins when used by itself or blended with another fluid have unique lubrication properties.

One embodiment is a new class of poly-alpha-olefins, which have a unique chemical composition characterized by a high degree of linear branches very regular structures with some unique head-to-head connections at the end position of the polymer chain. These compositions have a branch ratio of CH3/CH2<0.19. This branch ratio or CH3/CH2 ratio in the polymer fraction is calculated from the weight fractions of methyl groups obtained by infrared methods published in *Analytical Chemistry*, Vol. 25, No. 10, P. 1466 (1953).

This improved process to produce these polymers employs metallocene catalysts together with one or more activators (such as an alumoxane or a non-coordinating anion) and optionally with co-activators such as trialkylaluminum compounds. The metallocene catalyst can be a bridged or unbridged, substituted or unsubstituted cyclopentadienyl, indenyl or fluorenyl compound. One preferred class of catalysts are highly substituted metallocenes that give high catalyst productivity and higher product viscosity. Another preferred class of metallocenes are bridged and substituted cyclopentadienes. Another preferred class of metallocenes are bridged and substituted indenes or fluorenes. One aspect of the processes described herein also includes treatment of the feed olefins to remove catalyst poisons, such as peroxides, oxygen, sulfur, nitrogen-containing organic compounds, and or acetylenic compounds. This treatment is believed to increase catalyst productivity, typically more than 5 fold, preferably more than 10 fold.

A preferred embodiment is a process to produce a polyalpha-olefin comprising:

1) contacting at least one alpha-olefin monomer having 3 to 30 carbon atoms with a metallocene compound and an activator under polymerization conditions wherein hydrogen, if present, is present at a partial pressure of 200 psi (1379 kPa) or less, based upon the total pressure of the reactor (preferably 150 psi (1034 kPa) or less, preferably 100 psi (690 kPa) or less, preferably 50 psi (345 kPa) or less, preferably 25 psi (173 kPa) or less, preferably 10 psi (69 kPa) or less (alternately the hydrogen, if present in the reactor at 30,000 ppm or less by weight, preferably 1,000 ppm or less preferably 750 ppm or less, preferably 500 ppm or less, preferably 250 ppm or less, preferably 100 ppm or less, preferably 50 ppm or less, preferably 25 ppm or less, preferably 10 ppm or less, preferably 5 ppm or less), and wherein the alpha-olefin monomer having 3 to 30 carbon atoms is present at 10 volume % or more based upon the total volume of the catalyst/activator/co-activator solutions, monomers, and any diluents or solvents present in the reaction; and 2) obtaining a polyalpha-olefin, optionally hydrogenating the PAO, and obtaining a PAO, comprising at least 50 mole % of a C3 to C30 alpha-olefin monomer, wherein the polyalpha-olefin has a kinematic viscosity at 100° C. of 5000 cSt or less, and the polyalpha-olefin comprises Z mole % or more of units represented by the formula:

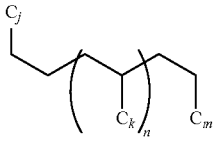

where j, k and m are each, independently, 1, 2, 3, 4, 5, 6, 7, 8, 9, 10, 11, 12, 13, 14, 15, 16, 17, 18, 19, 20, 21, or 22, n is an integer from 1 to 350, and An alternate embodiment is a process to produce a polyalpha-olefin comprising:

1) contacting a feed stream comprising one or at least one alpha-olefin monomer having 3 to 30 carbon atoms with a metallocene catalyst compound and a non-coordinating anion activator or alkylalumoxane activator, and optionally an alkyl-aluminum compound, under polymerization conditions wherein the alpha-olefin monomer having 3 to 30 carbon atoms is present at 10 volume % or more based upon the total volume of the catalyst/activator/co-activator solution, monomers, and any diluents or solvents present in the reactor and where the feed alpha-olefin, diluent or solvent stream comprises less than 300 ppm of heteroatom containing compounds; and obtaining a polyalpha-olefin comprising at least 50 mole % of a C5 to C24 alpha-olefin monomer where the polyalpha-olefin has a kinematic viscosity at 100° C. of 5000 cSt or less. Preferably, hydrogen, if present is present in the reactor at 30,000 ppm or less by weight, preferably 1,000 ppm or less preferably 750 ppm or less, preferably 500 ppm or less, preferably 250 ppm or less, preferably 100 ppm or less, preferably 50 ppm or less, preferably 25 ppm or less, preferably 10 ppm or less, preferably 5 ppm or less.

An alternate embodiment is a process to produce a polyalpha-olefin comprising:

1) contacting a feed stream comprising at least one alpha-olefin monomer having 3 to 30 carbon atoms with a metallocene catalyst compound and a non-coordinating anion activator or alkylalumoxane activator, and optionally an alkyl-aluminum compound, under polymerization conditions wherein the alpha-olefin monomer having 3 to 30 carbon atoms is present at 10 volume % or more based upon the total volume of the catalyst/activator/co-activator solution, monomers, and any diluents or solvents present in the reactor and where the feed alpha-olefin, diluent or solvent stream comprises less than 300 ppm of heteroatom containing compounds which; and obtaining a polyalpha-olefin comprising at least 50 mole % of a C5 to C24 alpha-olefin monomer where the polyalpha-olefin has a kinematic viscosity at 100° C. of 5000 cSt or less; Alternately, in this process described herein hydrogen, if present, is present in the reactor at 1000 ppm or less by weight, preferably 750 ppm or less, preferably 500 ppm or less, preferably 250 ppm or less, preferably 100 ppm or less, preferably 50 ppm or less, preferably 25 ppm or less, preferably 10 ppm or less, preferably 5 ppm or less.

2) isolating the lube fraction polymers and then contacting this lube fraction with hydrogen under typical hydrogenation conditions with hydrogenation catalyst to give fluid with bromine number below 1.8, or alternatively, isolating the lube fraction polymers and then contacting this lube fraction with hydrogen under more severe conditions with hydrogenation catalyst to give fluid with bromine number below 1.8 and with reduce mole % of mm components than the unhydrogenated polymers. The hydrogen pressure for this process is usually in the range from 50 psi to 3000 psi, preferably 200 to 2000 psi, preferably 500 to 1500 psi.

Molecular Weight Distribution (MWD)

Molecular weight distribution is a function of viscosity. The higher the viscosity the higher the molecular weight distribution. FIG. 1 is a graph showing the molecular weight distribution as a function of viscosity at Kv100° C. The circles represent the prior art prior art PAO. The squares and upper triangles represent the new metallocene catalyzed PAOs. Line 1 represents the preferred lower range of molecular weight distribution for the high viscosity metallocene catalyzed PAO. Line 3 represents preferred upper range of the molecular weight distribution for the high viscosity metallocene catalyzed PAO. Therefore, the region bounded by lines 1 and 3 represents the preferred molecular weight distribution region of the new metallocene catalyzed PAO. Line 2 represents the desirable and typical MWD of actual experimental samples of the metallocene PAO made from 1-decene. Line 5 represents molecular weight distribution of the prior art PAO.

Equation 1 represents the algorithm for line 5 or the average molecular weight distribution of the prior art PAO. Whereas equations 2, 3, and 4 represent lines 1, 3 and 2 respectively.

$$MWD=0.2223+1.0232*\log(Kv \text{ at } 100^\circ C. \text{ in cSt}) \quad \text{Eq. 1}$$

$$MWD=0.41667+0.725*\log(Kv \text{ at } 100^\circ C. \text{ in cSt}) \quad \text{Eq. 2}$$

$$MWD=0.8+0.3*\log(Kv \text{ at } 100^\circ C. \text{ in cSt}) \quad \text{Eq. 3}$$

$$MWD=0.66017+0.44922*\log(Kv \text{ at } 100^\circ C. \text{ in cSt}) \quad \text{Eq. 4}$$

In at least one embodiment, the molecular weight distribution is at least 10 percent less than equation 1. In a preferred embodiment the molecular weight distribution is less than equation 2 and in a most preferred embodiment the molecular weight distribution is less than equation 2 and more than equation 4.

Table 1 is a table demonstrating the differences between metallocene catalyzed PAO ("mPAO") and current high viscosity prior art PAO (cHVI-PAO). Examples 1 to 8 in the Table 1 were prepared from different feed olefins using metallocene catalysts. The metallocene catalyst system, products, process and feeds were described in Patent Applications Nos. PCT/US2006/021399 and PCT/US2006/021231. The mPAOs samples in Table were made from C10, C6,12, C6 to C18, C6,10,14-LAOs. Examples 1 to 7 samples all have very narrow molecular weight distribution (MWD). The MWD of mPAO depends on fluid viscosity as shown in FIG. 1.

Lubricant Formulation

The formulation is based on extreme modal blends of high viscosity synthetic group IV PAO. In a preferred embodiment, a High Viscosity Index, metallocene-catalyzed PAO of greater than 135 cSt is blended with a low-viscosity base stock PAO and/or with one or more of Gr V base stocks, such as an ester, a polyalkylene glycol or an alkylated aromatic, as a co-base for additive solubility. A detailed description of suitable Gr V base stocks can be found in "Synthetics, Mineral Oils and Bio-Based Lubricants, Chemistry and Technology" Edited by L. R. Rudnick, published by CRC Press, Taylor & Francis, 2005. The esters of choice are dibasic esters (such as adipate ester, ditridecyl adipate), mono-basic esters, polyol esters, including pentherythyol (TMP esters), and phthalate esters. We have discovered that TMP ester in combination with metallocene-catalyzed PAO of over 135 cST provides additional benefits as shown in the examples below.

TABLE 1

| | Example No. | | | | | | | | | | |
|---|---|---|---|---|---|---|---|---|---|---|---|
| | 1 | 2 | 3 | 4 | 5 | 6 | 7 | 8 | 9 | 10 | 11 |
| Sample type | mPAO | mPAO | mPAO | mPAO | mPAO | mPAO | mPAO | mPAO | cHVI-PAO | cHVI-PAO | cHVI PAO |
| Feed LAO | C6/C12 | C6-C18 | C6-C18 | C10 | C6, 10, 14 | C6, 10, 14 | C10 | C10 | C10 | C10 | C10 |
| 100° C. Kv, cS | 150 | 151 | 540 | 671 | 460 | 794.35 | 1386.63 | 678.1 | 150 | 300 | 1,000 |
| 40° C. Kv, cS | 1701 | 1600 | 6642 | 6900 | 5640 | 10,318 | 16362 | 6743 | 1500 | 3100 | 10,000 |
| VI | 199 | 207 | 257 | | 248 | 275 | 321 | 303 | 218 | 241 | 307 |
| Pour, ° C. | −33 | −36 | −21 | −18 | nd | nd | | −12 | −33 | −27 | −18 |
| MWD by GPC | | | | | | | | | | | |
| Mw | 7,409 | 8,089 | 17,227 | 19,772 | 16,149 | 20,273 | 31,769 | 29,333 | 8,974 | 12,511 | 32,200 |
| MWD | 1.79 | 2.01 | 1.90 | 1.98 | 2.35 | 2.18 | 1.914 | 5.50 | 2.39 | 2.54 | 4.79 |
| % Visc. Change by TRB Test(a) | | | | | | | | | | | |
| 20 hrs. | −0.33 | −0.65 | −2.66 | −3.64 | −4.03 | −8.05 | −19.32 | −29.11 | −7.42 | −18.70 | −46.78 |
| 100 hrs. | −0.83 | −0.70 | −1.07 | 1.79 | nd | nd | nd | nd | nd | −21.83 | −51.09 |

When Example 1 to 7 samples were subjected to tapered roller bearing ("TRB") test, they show very low viscosity loss after 20 hours shearing or after extended 100 hours shearing (TRB). Generally, shear stability is a function of fluid viscosity. Lower viscosity fluids have minimal viscosity losses of less than 10%. When fluid viscosity is above 1000 cS as in Example 7, the fluid loss is approximately 19% viscosity. Example 8 is a metallocene PAO with MWD of 5.5. This metallocene PAO shows significant amount of viscosity loss at 29%.

Examples 9, 10 and 11 are comparative examples. The high viscosity PAO are made according to methods described in U.S. Pat. Nos. 4,827,064 and 4,827,073. They have broad MWD and therefore poor shear stability in TRB test.

Figure 2:
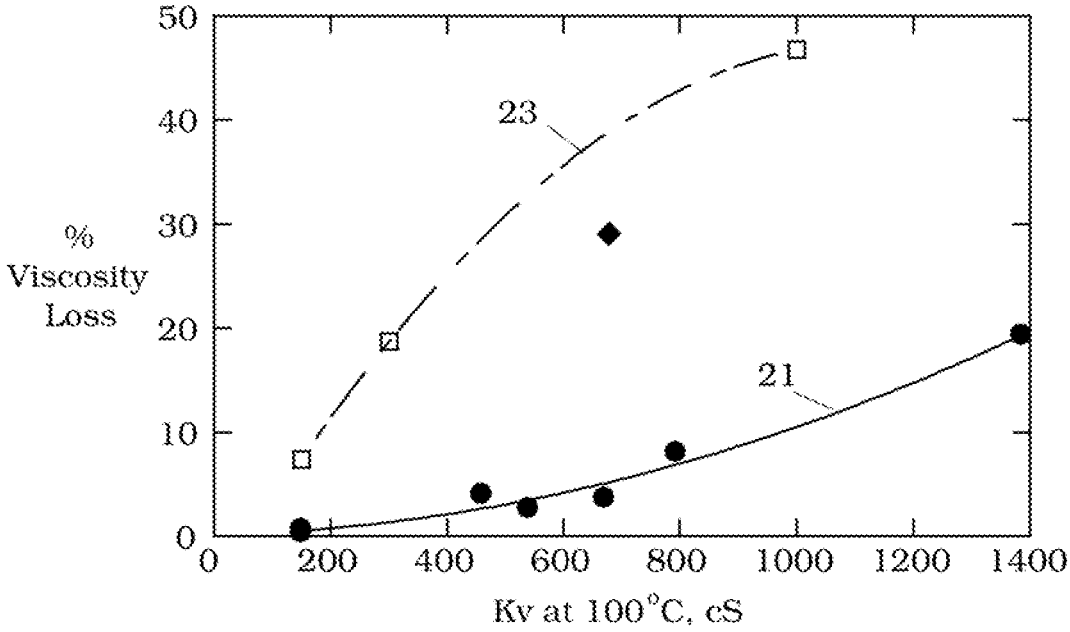
FIG. 2 is a graph illustrating the improved viscosities losses or improved shear stability as a function of the viscosity of the high viscosity metallocene catalyzed base stocks.

The comparison of shear stability as a function of fluid viscosity for mPAO with narrow MWD vs. cHVI-PAO is summarized in FIG. 2. This graph demonstrates that the mPAO profile shown as line 21 has much improved shear stability over wide viscosity range when compared to the cHVI-PAO profile shown as line 23.

These examples demonstrated the importance of MWD effect on shear stability. Accordingly, the higher viscosity base stocks with tighter molecular weight distributions provide favorable shear stability even at high viscosities.

The alkylated aromatics of choice are alkylbenzene, alkylated naphthalene and other alkylated aromatics such as alkylated diphenylether, diphenylsulfide, biphenyl, etc. We have found that this unique base stock combination can impart enhanced worm gear efficiency, improved air-release property and decrease in operating temperature.

Also, unexpected and significant air release benefits result from this discovery. Specifically, decreased air release times according to ASTM D 3427. These air release benefits are manifest in a decrease of as much as 75% of the standard release times of gear oil viscosity-grade lubricants. In addition to the above mentioned benefits, we also discovered, significant improvements in low temperature performance (reduction in pour point) and enhanced pumpability at low temperatures.

In one embodiment, the lubricant oil comprises at least two base stock blends of oil. The first base stock blend comprises lubricant oil with a viscosity of over 135 cSt, and more preferably 150 and higher cSt, Kv100° C. Most preferably, the base stock is over 135 cSt, Kv100° C. but less than 5000 cSt. The first base stock has a molecular weight distribution less than 10 percent of equation 1.

The second base stock blend comprises a lubricant oil with a viscosity of less than 60 cSt and preferably less than 40 cSt, and most preferably less than 10 cSt. Preferably, the viscosity of the second lubricant should be at least 1.5 cSt. Even more preferable is a viscosity of between 1.7 and 40 cSt.

The air release performance enhancement of the current invention is an unexpected result since the typical performance of these very viscous oils (ISO 460) is typically an air release time to 0.2% air in the ASTM D3427 test to be 20 minutes or more. Also, the low temperature performance of these novel formulations shows significant improvement as demonstrated in the ASTM D97 and D5133 data shown in Table 2. The air release performance enhancement of the current invention is unexpected and novel since the typical performance of these very viscous oils (ISO 460) is typically an air release time to 0.2% air in the ASTM D3427 test to be 20 minutes or more.

TABLE 2

ASTM D3427 (75C) Results

| Air Release in Minutes | Current Invention ISO 460Gear Oil | Commercially available ISO 460Gear Oil |
|---|---|---|
| Time to 0.1% air | 6.9 | 25 |
| Time to 0.2% air | 5.2 | 21 |

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stock generally has a viscosity index greater than about 120 and contains less than or equal to about 0.03% sulfur and greater than about 90% saturates. Group IV includes polyalphaolefins (PAO). Group V base stocks include base stocks not included in Groups I-IV. Table 3 summarizes properties of each of these five groups. All discussion of Gr I to V base stocks can be found in "Synthetics, Mineral Oils and Bio-Based Lubricants, Chemistry and Technology" Edited by L. R. Rudnick, published by CRC Press, Taylor & Francis, 2005.

Group VI in Table 3 are Polyinternal olefins ("PIO"). Polyinternal olefins are long-chain hydrocarbons, typically a linear backbone with some branching randomly attached; they are obtained by oligomerization of internal n-olefins. The catalyst is usually a BF3 complex with a proton source that leads to a cationic polymerization, or promoted BF3 or AlCl3 catalyst system. The process to produce polyinternal olefins (PIO) consists of four steps: reaction, neutralization/washing, hydrogenation and distillation. These steps are somewhat similar to PAO process. PIO are typically available in low viscosity grades, 4 cSt, 6 cSt and 8 cSt. If necessary, low viscosity, 1.5 to 3.9 cSt can also be made conveniently by the BF3 process or other cationic processes. Typically, the n-olefins used as starting material are n-C12-C18 internal olefins, more preferably, n-C14-C16 olefins are used. PIO can be made with VI and pour points very similar to PAO, only slightly inferior. They can be used in engine and industrial lubricant formulations. For more detailed discussion, see Chapter 2, Polyinternalolefins in the book, "Synthetics, Mineral Oils, and Bio-Based Lubricants—Chemistry and Technology" Edited by Leslie R. Rudnick, p. 37-46, published by CRC Press, Taylor & Francis Group, 2006; or "Polyinternal Olefins" by Corsico, G.; Mattei, L.; Roselli, A.; Gommellini, Carlo. EURON, Milan, Italy. Chemical Industries (Dekker) (1999), 77 (Synthetic Lubricants and High-Performance Functional Fluids, (2nd Edition)), 53-62. Publisher: Marcel Dekker, Inc. PIO was classified by itself as Group VI fluid in API base stock classification.

TABLE 3

Base Stock Properties

| | Saturates | Sulfur | Viscosity Index |
|---|---|---|---|
| Group I | <90% and/or | >0.03% and | ≧80 and <120 |
| Group II | ≧90% and | ≦0.03% and | ≧80 and <120 |
| Group III | ≧90% and | ≦0.03% and | ≧120 |
| Group IV | Polyalphaolefins (PAO) | | |
| Group V | All other base oil stocks not included in Groups I, II, III, or IV | | |
| Group VI | Polyinternal olefins (PIO) | | |

In a preferred embodiment, the base stocks include at least one base stock of synthetic oils and most preferably include at least one base stock of API group IV Poly Alpha Olefins. Synthetic oil for purposes of this application shall include all oils that are not naturally occurring mineral oils. Naturally occurring mineral oils are often referred to as API Group I oils.

A new type of PAO lubricant was introduced by U.S. Pat. Nos. 4,827,064 and 4,827,073 (Wu). These PAO materials, which are produced by the use of a reduced valence state chromium catalyst, are olefin oligomers or polymers which are characterized by very high viscosity indices which give them very desirable properties to be useful as lubricant base stocks and, with higher viscosity grades; as VI improvers. They are referred to as High Viscosity Index PAOs or HVI-PAOs. The relatively low molecular weight high viscosity PAO materials were found to be useful as lubricant base stocks whereas the higher viscosity PAOs, typically with viscosities of 100 cSt or more, e.g. in the range of 100 to 1,000 cSt, were found to be very effective as viscosity index improvers for conventional PAOs and other synthetic and mineral oil derived base stocks.

Various modifications and variations of these high viscosity PAO materials are also described in the following U.S. patents to which reference is made: U.S. Pat. Nos. 4,990,709; 5,254,274; 5,132,478; 4,912,272; 5,264,642; 5,243,114; 5,208,403; 5,057,235; 5,104,579; 4,943,383; 4,906,799. These oligomers can be briefly summarized as being produced by the oligomerization of 1-olefins in the presence of a metal oligomerization catalyst which is a supported metal in a reduced valence state. The preferred catalyst comprises a reduced valence state chromium on a silica support, prepared by the reduction of chromium using carbon monoxide as the reducing agent. The oligomerization is carried out at a temperature selected according to the viscosity desired for the resulting oligomer, as described in U.S. Pat. Nos. 4,827,064 and 4,827,073. Higher viscosity materials may be produced as described in U.S. Pat. No. 5,012,020 and U.S. Pat. No. 5,146,021 where oligomerization temperatures below about 90° C. are used to produce the higher molecular weight oligomers. In all cases, the oligomers, after hydrogenation when necessary to reduce residual unsaturation, have a branching index (as defined in U.S. Pat. Nos. 4,827,064 and 4,827,073) of less than 0.19. Overall, the HVI-PAO normally have a viscosity in the range of about 12 to 5,000 cSt.

Furthermore, the HVI-PAOs generally can be characterized by one or more of the following: C30-C1300 hydrocarbons having a branch ratio of less than 0.19, a weight average molecular weight of between 300 and 45,000, a number average molecular weight of between 300 and 18,000, a molecular weight distribution of between 1 and 5. Particularly preferred HVI-PAOs are fluids with 100° C. viscosity ranging from 5 to 5000 cSt. In another embodiment, viscosities of the HVI-PAO oligomers measured at 100° C. range from 3 centistokes ("cSt") to 15,000 cSt. Furthermore, the fluids with viscosity at 100° C. of 3 cSt to 5000 cSt have VI calculated by ASTM method D2270 greater than 130. Usually they range from 130 to 350. The fluids all have low pour points, below −15° C.

The HVI-PAOs can further be characterized as hydrocarbon compositions comprising the polymers or oligomers made from 1-alkenes, either by itself or in a mixture form, taken from the group consisting of C6-C20 1-alkenes. Examples of the feeds can be 1-hexene, 1-octene, 1-decene, 1-dodecene, 1-tetradecene, etc. or mixture of C6 to C14 1-alkenes or mixture of C6 to C20 1-alkenes, C6 and C12 1-alkenes, C6 and C14 1-alkenes, C6 and C16 1-alkenes, C6 and C18 1-alkenes, C8 and C10 1-alkenes, C8 and C12 1-alkenes, C8, C10 and C12 1-alkenes, and other appropriate combinations.

The lube products usually are distilled to remove any low molecular weight compositions such as these boiling below 600° F., or with carbon number less than C20, if they are produced from the polymerization reaction or are carried over from the starting material. This distillation step usually improves the volatility of the finished fluids. In certain special applications, or when no low boiling fraction is present in the reaction mixture, this distillation is not necessary. Thus the whole reaction product after removing any solvent or starting material can be used as lube base stock or for the further treatments.

The lube fluids made directly from the polymerization or oligomerization process usually have unsaturated double bonds or have olefinic molecular structure. The amount of double bonds or unsaturation or olefinic components can be measured by several methods, such as bromine number (ASTM 1159), bromine index (ASTM D2710) or other suitable analytical methods, such as NMR, IR, etc. The amount of the double bond or the amount of olefinic compositions depends on several factors—the degree of polymerization, the amount of hydrogen present during the polymerization process and the amount of other promoters which participate in the termination steps of the polymerization process, or other agents present in the process. Usually, the amount of double bonds or the amount of olefinic components is decreased by the higher degree of polymerization, the higher amount of hydrogen gas present in the polymerization process, or the higher amount of promoters participating in the termination steps.

It was known that, usually, the oxidative stability and light or UV stability of fluids improves when the amount of unsaturation double bonds or olefinic contents is reduced. Therefore it is necessary to further hydrotreat the polymer if they have high degree of unsaturation. Usually, the fluids with bromine number of less than 5, as measured by ASTM D1159, is suitable for high quality base stock application. Of course, the lower the bromine number, the better the lube quality. Fluids with bromine number of less than 3 or 2 are common. The most preferred range is less than 1 or less than 0.1. The method to hydrotreat to reduce the degree of unsaturation is well known in literature [U.S. Pat. No. 4,827,073, example 16). In some HVI-PAO products, the fluids made directly from the polymerization already have very low degree of unsaturation, such as those with viscosities greater than 150 cSt at 100° C. They have bromine numbers less than 5 or even below 2. In these cases, we can chose to use as is without hydrotreating, or we can choose to hydrotreating to further improve the base stock properties.

Another type of PAO, classified as Group IV base stock and used extensively in many synthetic or partial synthetic industrial lubricants, is produced by oligomerization or polymerization of linear alpha-olefins of C6 to C16 by promoted BF3 or AlCl3 catalysts. This type of PAO is available in many viscosity grades ranging from 1.7 cSt to 100 cSt from ExxonMobil Chemical Co.

Base stocks having a high paraffinic/naphthenic and saturation nature of greater than 90 weight percent can often be used advantageously in certain embodiments. Such base stocks include Group II and/or Group III hydroprocessed or hydrocracked base stocks, or their synthetic counterparts such as polyalphaolefin oils, GTL or similar base oils or mixtures of similar base oils. For purposes of this application synthetic bases stocks shall include Group II, Group III, group IV and Group V base stocks.

A more specific example embodiment, is the combination of high viscosity metallocene catalyzed PAO having a molecular weight distribution (MWD) as a function of viscosity at least 10 percent less than the algorithm: [MWD=0.2223+1.0232*log (Kv at 100° C. in cSt)] with a low viscosity Poly Alpha Olefin ("PAO") including PAOs with a viscosity of less than 6 cSt, and more preferably with a viscosity between 1.5 cSt or 4 cSt, Kv100° C. and even more preferably with a small amount of Group V base stocks, including esters, polyalkylene glycols, or alkylated aromatics. The Gr V base stocks can be used as an additional base stock or as a co-base stock with either the first and second base stocks for additive solubility. The preferred ester is an alkyl adipate, TMP ester, a polyol ester or aromatic ester, such as phthalate ester. The preferred alkyl aromatics are alkylbenzenes or alkylnaphthalenes. The preferred polyalkylene glycols are liquid polymers or copolymers made from ethylene oxide, propylene oxide, butylenes oxides or higher alkylene oxides with some degree of compatibility with PAO, other hydrocarbon fluids, GTL or mineral oils.

Gas to liquid (GTL) base stocks can also be preferentially used with the components of this invention as a portion or all of the base stocks used to formulate the finished lubricant. We have discovered, favorable improvement when the components of this invention are added to lubricating systems comprising primarily Group II, Group III and/or GTL base stocks compared to lesser quantities of alternate fluids.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) include oils boiling in the lube oil boiling range separated/fractionated from GTL materials such as by, for example, distillation or thermal diffusion, and subsequently subjected to well-known catalytic or solvent dewaxing processes to produce lube oils of reduced/low pour point; wax isomerates, comprising, for example, hydroisomerized or isodewaxed synthesized hydrocarbons; hydro-isomerized or isodewaxed Fischer-Tropsch ("F-T") material (i.e., hydrocarbons, waxy hydrocarbons, waxes and possible analogous oxygenates);

preferably hydroisomerized or isodewaxed F-T hydrocarbons or hydroisomerized or isodewaxed F-T waxes, hydroisomerized or isodewaxed synthesized waxes, or mixtures thereof.

GTL base stock(s) derived from GTL materials, especially, hydroisomerized/isodewaxed F-T material derived base stock(s), and other hydroisomerized/isodewaxed wax derived base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about 4 $mm^2/s$ at 100° C. and a viscosity index of about 130 or greater. The term GTL base oil/base stock and/or wax isomerate base oil/base stock as used herein and in the claims is to be understood as embracing individual fractions of GTL base stock/base oil or wax isomerate base stock/base oil as recovered in the production process, mixtures of two or more GTL base stocks/base oil fractions and/or wax isomerate base stocks/base oil fractions, as well as mixtures of one or two or more low viscosity GTL base stock(s)/base oil fraction(s) and/or wax isomerate base stock(s)/base oil fraction(s) with one, two or more high viscosity GTL base stock(s)/base oil fraction(s) and/or wax isomerate base stock(s)/base oil fraction(s) to produce a bi-modal blend wherein the blend exhibits a viscosity within the aforesaid recited range. Reference herein to Kinematic Viscosity refers to a measurement made by ASTM method D445.

GTL base stocks and base oils derived from GTL materials, especially hydroisomerized/isodewaxed F-T material derived base stock(s), and other hydroisomerized/isodewaxed wax-derived base stock(s), such as wax hydroisomerates/isodewaxates, which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM D97 and similar automated versions.

The GTL base stock(s) derived from GTL materials, especially hydroisomerized/isodewaxed F-T material derived base stock(s), and other hydroisomerized/isodewaxed wax-derived base stock(s) which are base stock components which can be used in this invention are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) are typically highly paraffinic of greater than 90 percent saturates) and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s), hydroisomerized or isodewaxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949 for example.

We have discovered that this unique base stock combination can impart even further favorable properties when combined with specific additive systems. The additives include various commercially available gear oil packages. These additive packages include a high performance series of components that include antiwear, antioxidant, defoamant, demulsifier, detergent, dispersant, metal passivation, and rust inhibition additive chemistries to deliver desired performance.

The additives may be chosen to modify various properties of the lubricating oils. For gear oils, the additives should provide the following properties, antiwear protection, rust protection, micropitting protection, friction reduction, and improved filterability. Persons skilled in the art will recognize various additives that can be chosen to achieve favorable properties including favorable properties for gear oil applications.

The final lubricant should comprise a first lubricant base stock having a viscosity of greater than 135 cSt, Kv100° C. The first lubricant base stock should comprise of at least 10 percent and no more than 70 percent of the final lubricant. Preferred range is at least 20 percent to 60 percent. The second base stock having a viscosity less than 100 cSt should comprise at least 10 percent and no more than 70 percent of the final base stock total. The amount of Group V base stocks, such as esters, polyalkylene glycols or alkylated aromatics and/or additive can be up to 90 percent of the final lubricant total with a proportional decrease in the acceptable ranges of first and second base stocks. The preferred range of group V, such as esters and additives is between 10 and 90 percent. Sometimes, some Group I or II base stock can be used in the formulation together with ester or alkylated aromatics or as a total substitute.

In various embodiments, it will be understood that additives well known as functional fluid additives in the art, can also be incorporated in the functional fluid composition of the invention, in relatively small amounts, if desired; frequently, less than about 0.001% up to about 10-20% or more. In one embodiment, at least one oil additive is added from the group consisting of antioxidants, stabilizers, antiwear additives, dispersants, detergents, antifoam additives, viscosity index improvers, copper passivators, metal deactivators, rust inhibitors, corrosion inhibitors, pour point depressants, demulsifiers, anti-wear agents, extreme pressure additives and friction modifiers. The additives listed below are non-limiting examples and are not intended to limit the claims.

Dispersants should contain the alkenyl or alkyl group R has an Mn value of about 500 to about 5000 and an Mw/Mn ratio of about 1 to about 5. The preferred Mn intervals depend on the chemical nature of the agent improving filterability. Polyolefinic polymers suitable for the reaction with maleic anhydride or other acid materials or acid forming materials, include polymers containing a predominant quantity of C.sub.2 to C.sub.5 monoolefins, for example, ethylene, propylene, butylene, isobutylene and pentene. A highly suitable polyolefinic polymer is polyisobutene. The succinic anhydride preferred as a reaction substance is PIBSA, that is, polyisobutenyl succinic anhydride.

If the dispersant contains a succinimide comprising the reaction product of a succinic anhydride with a polyamine, the alkenyl or alkyl substituent of the succinic anhydride serving as the reaction substance consists preferably of polymerised isobutene having an Mn value of about 1200 to about 2500. More advantageously, the alkenyl or alkyl substituent of the succinic anhydride serving as the reaction substance consists in a polymerised isobutene having an Mn value of about 2100 to about 2400. If the agent improving filterability contains an ester of succinic acid comprising the reaction product of a succinic anhydride and an aliphatic polyhydric alcohol, the alkenyl or alkyl substituent of the succinic anhydride serving as the reaction substance consists advantageously of a polymerised isobutene having an Mn value of 500 to 1500. In preference, a polymerised isobutene having an Mn value of 850 to 1200 is used.

Amides suitable uses of amines include antiwear agents, extreme pressure additives, friction modifiers or Dispersants. The amides which are utilized in the compositions of the present invention may be amides of mono- or polycarboxylic acids or reactive derivatives thereof. The amides may be characterized by a hydrocarbyl group containing from about 6 to about 90 carbon atoms; each is independently hydrogen or a hydrocarbyl, aminohydrocarbyl, hydroxyhydrocarbyl or a heterocyclic-substituted hydrocarbyl group, provided that both are not hydrogen; each is, independently, a hydrocarbylene group containing up to about 10 carbon atoms; Alk is an alkylene group containing up to about 10 carbon atoms.

The amide can be derived from a monocarboxylic acid, a hydrocarbyl group containing from 6 to about 30 or 38 carbon atoms and more often will be a hydrocarbyl group derived from a fatty acid containing from 12 to about 24 carbon atoms.

The amide is derived from a di- or tricarboxylic acid, will contain from 6 to about 90 or more carbon atoms depending on the type of polycarboxylic acid. For example, when the amide is derived from a dimer acid, will contain from about 18 to about 44 carbon atoms or more, and amides derived from trimer acids generally will contain an average of from about 44 to about 90 carbon atoms. Each is independently hydrogen or a hydrocarbyl, aminohydrocarbyl, hydroxyhydrocarbyl or a heterocyclic-substituted hydrocarbon group containing up to about 10 carbon atoms. It may be independently heterocyclic substituted hydrocarbyl groups wherein the heterocyclic substituent is derived from pyrrole, pyrroline, pyrrolidine, morpholine, piperazine, piperidine, pyridine, pipecoline, etc. Specific examples include methyl, ethyl, n-propyl, n-butyl, n-hexyl, hydroxymethyl, hydroxyethyl, hydroxypropyl, amino-methyl, aminoethyl, aminopropyl, 2-ethylpyridine, 1-ethylpyrrolidine, 1-ethylpiperidine, etc.

The alkyl group can be an alkylene group containing from 1 to about 10 carbon atoms. Examples of such alkylene groups include, methylene, ethylene, propylene, etc. Also are hydrocarbylene groups, and in particular, alkylene group containing up to about 10 carbon atoms. Examples of such hydrocarbylene groups include, methylene, ethylene, propylene, etc. The amide contains at least one morpholinyl group. In one embodiment, the morpholine structure is formed as a result of the condensation of two hydroxy groups which are attached to the hydrocarbylene groups. Typically, the amides are prepared by reacting a carboxylic acid or reactive derivative thereof with an amine which contains at least one >NH group.

Aliphatic monoamines include mono-aliphatic and di-aliphatic-substituted amines wherein the aliphatic groups may be saturated or unsaturated straight chain or branched chain. Such amines include, for example, mono- and di-alkyl-substituted amines, mono- and dialkenyl-substituted amines, etc. Specific examples of such monoamines include ethyl amine, diethyl amine, n-butyl amine, di-n-butyl amine, isobutyl amine, coco amine, stearyl amine, oleyl amine, etc. An example of a cycloaliphatic-substituted aliphatic amine is 2-(cyclohexyl)-ethyl amine Examples of heterocyclic-substituted aliphatic amines include 2-(2-aminoethyl)-pyrrole, 2-(2-aminoethyl)-1-methylpyrrole, 2-(2-aminoethyl)-1-methylpyrrolidine and 4-(2-aminoethyl)morpholine, 1-(2-aminoethyl)piperazine, 1-(2-aminoethyl)piperidine, 2-(2-aminoethyl)pyridine, 1-(2-aminoethyl)pyrrolidine, 1-(3-aminopropyl)imidazole, 3-(2-aminopropyl)indole, 4-(3-aminopropyl)morpholine, 1-(3-aminopropyl)-2-pipecoline, 1-(3-aminopropyl)-2-pyrrolidinone, etc.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexyl-amines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(para-methylphenyl)amine, naphthylamine, N-(n-butyl)-aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, variously substituted phenathiazines, and thienyl-substituted aniline.

Polyamines are aliphatic, cycloaliphatic and aromatic polyamines analogous to the above-described monoamines except for the presence within their structure of additional amino nitrogens. The additional amino nitrogens can be primary, secondary or tertiary amino nitrogens. Examples of such polyamines include N-amino-propyl-cyclohexylamines, N,N'-di-n-butyl-paraphenylene diamine, bis-(para-aminophenyl)methane, 1,4-diaminocyclohexane, and the like.

The hydroxy-substituted amines contemplated are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, 3-hydroxybutyl-amine, 4-hydroxybutyl-amine, diethanolamine, di-(2-hydroxyamine, N-(hydroxypropyl)-propylamine, N-(2-methyl)-cyclohexylamine, 3-hydroxycyclopentyl parahydroxyaniline, N-hydroxyethal piperazine and the like.

In one embodiment, the amines useful in the present invention are alkylene polyamines including hydrogen, or a hydrocarbyl, amino hydrocarbyl, hydroxyhydrocarbyl or heterocyclic-substituted hydrocarbyl group containing up to about 10 carbon atoms, Alk is an alkylene group containing up to about 10 carbon atoms, and is 2 to about 10. Preferably, Alk is ethylene or propylene. Usually, a will have an average value of from 2 to about 7. Examples of such alkylene polyamines include methylene polyamines, ethylene polyamines, butylene polyamines, propylene polyamines, pentylene polyamines, hexylene polyamines, heptylene polyamines, etc.

Alkylene polyamines include ethylene diamine, triethylene tetramine, propylene diamine, trimethylene diamine, hexamethylene diamine, decamethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27-39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than 2, usually less than 1% (by weight) material boiling below about 200.degree. C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100". Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

The dispersants are selected from:

Mannich bases that are condensation reaction products of a high molecular weight phenol, an alkylene polyamine and an aldehyde such as formaldehyde, Succinic-based dispersants that are reaction products of a olefin polymer and succinic acylating agent (acid, anhydride, ester or halide) further reacted with an organic hydroxy compound and/or an amine, High molecular weight amides and esters such as reaction products of a hydrocarbyl acylating agent and a polyhydric aliphatic alcohol (such as glycerol, pentaerythritol or sorbitol). Ashless (metal-free) polymeric materials that usually contain an oil soluble high molecular weight backbone linked to a polar functional group that associates with particles to be dispersed are typically used as dispersants. Zinc acetate capped, also any treated dispersant, which include borated, cyclic carbonate, end-capped, polyalkylene maleic anhydride and the like; mixtures of some of the above, in treat rates that range from about 0.1% up to 10-20% or more. Commonly used hydrocarbon backbone materials are olefin polymers and copolymers, i.e.—ethylene, propylene, butylene, isobutylene, styrene; there may may not be further functional groups incorporated into the backbone of the polymer, whose molecular weight ranges from 300 tp to 5000. Polar materials such as amines, alcohols, amides or esters are attached to the backbone via a bridge.

Antioxidants include sterically hindered alkyl phenols such as 2,6-di-tert-butylphenol, 2,6-di-tert-butyl-p-cresol and 2,6-di-tert-butyl-4-(2-octyl-3-propanoic) phenol; N,N-di (alkylphenyl) amines; and alkylated phenylene-diamines.

The antioxidant component may be a hindered phenolic antioxidant such as butylated hydroxytoluene, suitably present in an amount of 0.01 to 5%, preferably 0.4 to 0.8%, by weight of the lubricant composition. Alternatively, or in addition, component b) may comprise an aromatic amine antioxidant such as mono-octylphenylalphanapthylamine or p,p-dioctyldiphenylamine, used singly or in admixture. The amine anti-oxidant component is suitably present in a range of from 0.01 to 5% by weight of the lubricant composition, more preferably 0.5 to 1.5%.

A sulfur-containing antioxidant may be any and every antioxidant containing sulfur, for example, including dialkyl thiodipropionates such as dilauryl thiodipropionate and distearyl thiodipropionate, dialkyldithiocarbamic acid derivatives (excluding metal salts), bis(3,5-di-t-butyl-4-hydroxybenzyl)sulfide, mercaptobenzothiazole, reaction products of phosphorus pentoxide and olefins, and dicetyl sulfide. Of these, preferred are dialkyl thiodipropionates such as dilauryl thiodipropionate and distearyl thiodipropionate. The amine-type antioxidant includes, for example, monoalkyldiphenylamines such as monooctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamines such as tetrabutyldiphenylamine, tetrahexyldiphenylamine, tetraoctyldiphenylamine and tetranonyldiphenylamine; and naphthylamines such as .alpha.-naphthylamine, phenyl-.alpha.-naphthylamine, butylphenyl-.alpha.-naphthylamine, pentylphenyl-.alpha.-naphthylamine, hexylphenyl-.alpha.-naphthylamine, heptylphenyl-.alpha.-naphthylamine, octylphenyl-.alpha.-naphthylamine and nonylphenyl-.alpha.-naphthylamine. Of these, preferred are dialkyldiphenylamines. The sulfur-containing antioxidant and the amine-type antioxidant are added to the base oil in an amount of from 0.01 to 5% by weight, preferably from 0.03 to 3% by weight, relative to the total weight of the composition.

The oxidation inhibitors that are particularly useful in lube compositions of the invention are the hindered phenols (e.g., 2,6-di-(t-butyl)phenol); aromatic amines (e.g., alkylated diphenyl amines); alkyl polysulfides; selenides; borates (e.g., epoxide/boric acid reaction products); phosphorodithioic acids, esters and/or salts; and the dithiocarbamate (e.g., zinc dithiocarbamates). These oxidation inhibitors as well as the oxidation inhibitors discussed above the preferably of the invention at levels of about 0.05% to about 5%, more preferably about 0.25 to about 2% by weight based on the total weight of such compositions; with ratios of amine/phenolic to be from 1:10 to 10:1 of the mixtures preferred.

The oxidation inhibitors that are also useful in lube compositions of the invention are chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)(phosphorodithioate, cadmium dinonylphosphorodithioate, and the reaction of phosphorus pentasulfide with an equimolar mixture of isopropyl alcohol, 4-methyl-2-pentanol, and n-hexyl alcohol.

Oxidation inhibitors, organic compounds containing sulfur, nitrogen, phosphorus and some alkylphenols are also employed. Two general types of oxidation inhibitors are those that react with the initiators, peroxy radicals, and hydroperoxides to form inactive compounds, and those that decompose these materials to form less active compounds. Examples are hindered (alkylated) phenols, e.g. 6-di(tert-butyl)-4-methylphenol [2,6-di(tert-butyl)-p-cresol, DBPC], and aromatic amines, e.g. N-phenyl-.alpha.-naphthalamine. These are used in turbine, circulation, and hydraulic oils that are intended for extended service.

Examples of amine-based antioxidants include dialkyldiphenylamines such as p,p'-dioctyldiphenylamine (manufactured by the Seiko Kagaku Co. under the trade designation "Nonflex OD-3"), p,p'-di-.alpha.-methylbenzyl-diphenylamine and N-p-butylphenyl-N-p'-octylphenylamine; monoalkyldiphenylamines such as mono-t-butyldiphenylamine, and monooctyldiphenylamine; bis(dialkylphenyl) amines such as di(2,4-diethylphenyl)amine and di(2-ethyl-4-nonylphenyl)amine; alkylphenyl-1-naphthylamines such as octylphenyl-1-naphthylamine and N-t-dodecylphenyl-1-naphthylamine; arylnaphthylamines such as 1-naphthylamine, phenyl-1-naphthylamine, phenyl-2-naphthylamine, N-hexylphenyl-2-naphthylamine and N-octylphenyl-2-naphthylamine, phenylenediamines such as N,N'-diisopropyl-p-phenylenediamine and N,N'-diphenyl-p-phenylenediamine, and phenothiazines such as phenothiazine (manufactured by the Hodogaya Kagaku Co.: Phenothiazine) and 3,7-dioctylphenothiazine.

Examples of sulphur-based antioxidants include dialkylsulphides such as didodecylsulphide and dioctadecylsulphide; thiodipropionic acid esters such as didodecyl thiodipropionate, dioctadecyl thiodipropionate, dimyristyl thiodipropionate and dodecyloctadecyl thiodipropionate, and 2-mercaptobenzimidazole.

Examples of phenol-based antioxidants include 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone (manufactured by the Kawaguchi Kagaku Co. under trade designation "Antage DBH"), 2,6-di-t-butylphenol and 2,6-di-t-butyl-4-alkylphenols such as 2,6-di-t-butyl-4-methylphenol and 2,6-di-t-butyl-4-ethylphenol; 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptoocty-1 acetate, alkyl-3-(3,5-di-t-butyl-4-hydroxyphenyl)propionates such as n-octyl-3-(3,5-di-t-butyl-4-hydroxyphenyl)propionate (manufactured by the Yoshitomi Seiyaku Co. under the trade designation "Yonox SS"), n-dodecyl-3-(3,5-di-t-butyl-4-hydroxyphenyl) propionate and 2'-ethylhexyl-3-(3,5-di-t-butyl-4-hydroxyphenyl)propionate; 2,6-di-t-butyl-.alpha.-dimethylamino-p-cresol, 2,2'-methylenebis(4-alkyl-6-t-butylphenol) compounds such as 2,2'-methylenebis(4-methyl-6-t-butylphe-nol) (manufactured by the Kawaguchi Kagaku Co. under the trade designation "Antage W-400") and 2,2'-methylenebis(4-ethyl-6-t-butylphenol) (manufactured by the Kawaguchi Kagaku Co. under the trade designation "Antage W-500"); bisphenols such as 4,4'-butylidenebis(3-methyl-6-t-butyl-phenol) (manufactured by the Kawaguchi Kagaku Co. under the trade designation "Antage W-300"), 4,4'-methylenebis(2,6-di-t-butylphenol) (manufactured by Laporte Performance Chemicals under the trade designation "Ionox 220AH"), 4,4'-bis(2,6-di-t-butylphenol), 2,2-(di-p-hydroxyphenyl)propane (Bisphenol A), 2,2-bis(3,5-di-t-butyl-4-hydroxyphenyl)propane, 4,4'-cyclohexylidenebis(2,6-di-t-butylphenol), hexamethylene glycol bis[3, (3,5-di-t-butyl-4-hydroxyphenyl)propionate] (manufactured by the Ciba Speciality Chemicals Co. under the trade designation "Irganox L109"), triethylene glycol bis[3-(3-t-butyl-4-hydroxy-y-5-methylphenyl)propionate] (manufactured by the Yoshitomi Seiyaku Co. under the trade designation "Tominox 917"), 2,2'-thio[diethyl-3-(3,5-di-t-1-butyl-4-hydroxyphenyl)propionate] (manufactured by the Ciba Speciality Chemicals Co. under the trade designation "Irganox L115"), 3,9-bis{1,1-dimethyl-2-[3-(3-t-butyl-4-hydroxy-5-methylphenyl)-propionylo-xy]ethyl}2,4,8,10-tetraoxaspiro[5,5]undecane (manufactured by the Sumitomo Kagaku Co. under the trade designation "Sumilizer GA80") and 4,4'-thiobis(3-methyl-6-t-butylphenol) (manufactured by the Kawaguchi Kagaku Co. under the trade designation "Antage RC"), 2,2'-thiobis(4,6-di-t-butylresorcinol); polyphenols such as tetrakis[methylene-3-(3,5-di-t-butyl-4-hydroxyphenyl)propionato]methane (manufactured by the Ciba Speciality Chemicals Co. under the trade designation "Irganox L101"), 1,1,3-tris(2-methyl-4-hydroxy-5-t-butylpheny-1)butane (manufactured by the Yoshitomi Seiyaku Co. under the trade designation "Yoshinox 930"), 1,3,5-trimethyl-2,4,6-tris(3,5-di-t-butyl-4-hydroxybenzyl)benzene (manufactured by Ciba Speciality Chemicals under the trade designation "Irganox 330"), bis[3,3'-bis(4'-hydroxy-3'-t-butylpheny-1)butyric acid] glycol ester, 2-(3',5'-di-t-butyl-4-hydroxyphenyl)-methyl-4-(2",4"-di-t-butyl-3"-hydroxyphenyl)methyl-6-t-butylphenol and 2,6-bis(2'-hydroxy-3'-t-butyl-5'-methylbenzyl)-4-methylphenol; and phenol/aldehyde condensates such as the condensates of p-t-butylphenol and formaldehyde and the condensates of p-t-butylphenol and acetaldehyde.

Viscosity index improvers and/or the pour point depressant include polymeric alkylmethacrylates and olefinic copolymers such as an ethylene-propylene copolymer or a styrene-butadiene copolymer or polyalkene such as PIB. Viscosity index improvers (VI improvers), high molecular weight polymers that increase the relative viscosity of an oil at high temperatures more than they do at low temperatures. The most common VI improvers are methacrylate polymers and copolymers, acrylate polymers, olefin polymers and copolymers, and styrene-butadiene copolymers.

Other examples of the viscosity index improver include polymethacrylate, polyisobutylene, alpha-olefin polymers, alpha-olefin copolymers (e.g., an ethylene-propylene copolymer), polyalkylstyrene, phenol condensates, naphthalene condensates, a styrenebutadiene copolymer and the like. Of these, polymethacrylate having a number average molecular weight of 10,000 to 300,000, and alpha-olefin polymers or alpha-olefin copolymers having a number average molecular weight of 1,000 to 30,000, particularly ethylene-alpha-olefin copolymers having a number average molecular weight of 1,000 to 10,000 are preferred.

The viscosity index increasing agents which can be used include, for example, polymethacrylates and ethylene/propylene copolymers, other non-dispersion type viscosity index increasing agents such as olefin copolymers like styrene/diene copolymers, and dispersible type viscosity index increasing agents where a nitrogen containing monomer has been copolymerized in such materials. These materials can be added and used individually or in the form of mixtures, conveniently in an amount within the range of from 0.05 to 20 parts by weight per 100 parts by weight of base oil.

Pour point depressors (PPD) include polymethacrylates. Commonly used additives such as alkylaromatic polymers and polymethacrylates are useful for this purpose; typically the treat rates range from 0.001% to 1.0%.

Detergents include calcium alkylsalicylates, calcium alkylphenates and calcium alkarylsulfonates with alternate metal ions used such as magnesium, barium, or sodium. Examples of the cleaning and dispersing agents which can be used include metal-based detergents such as the neutral and basic alkaline earth metal sulphonates, alkaline earth metal phenates and alkaline earth metal salicylates alkenylsuccinimide and alkenylsuccinimide esters and their borohydrides, phenates, salienius complex detergents and ashless dispersing agents which have been modified with sulphur compounds. These agents can be added and used individually or in the form of mixtures, conveniently in an amount within the range of from 0.01 to 1 part by weight per 100 parts by weight of base oil; these can also be high TBN, low TBN, or mixtures of high/low TBN.

Anti-rust additives include (short-chain) alkenyl succinic acids, partial esters thereof and nitrogen-containing derivatives thereof; and synthetic alkarylsulfonates, such as metal dinonylnaphthalene sulfonates. Anti-rust agents include, for example, monocarboxylic acids which have from 8 to 30 carbon atoms, alkyl or alkenyl succinates or partial esters thereof, hydroxy-fatty acids which have from 12 to 30 carbon atoms and derivatives thereof, sarcosines which have from 8 to 24 carbon atoms and derivatives thereof, amino acids and derivatives thereof, naphthenic acid and derivatives thereof, lanolin fatty acid, mercapto-fatty acids and paraffin oxides.

Particularly preferred anti-rust agents are indicated below. Examples of Monocarboxylic Acids (C8-C30), Caprylic acid, pelargonic acid, decanoic acid, undecanoic acid, lauric acid, myristic acid, palmitic acid, stearic acid, arachic acid, behenic acid, cerotic acid, montanic acid, melissic acid, oleic acid, docosanic acid, erucic acid, eicosenic acid, beef tallow fatty acid, soy bean fatty acid, coconut oil fatty acid, linolic acid, linoleic acid, tall oil fatty acid, 12-hydroxystearic acid, laurylsarcosinic acid, myritsylsarcosinic acid, palmitylsarcosinic acid, stearylsarcosinic acid, oleylsarcosinic acid, alkylated (C8-C20) phenoxyacetic acids, lanolin fatty acid and C8-C24 mercapto-fatty acids.

Examples of Polybasic Carboxylic Acids: The alkenyl (C10-C100) succinic acids indicated in CAS No. 27859-58-1 and ester derivatives thereof, dimer acid, N-acyl-N-alkyloxyalkyl aspartic acid esters (U.S. Pat. No. 5,275,749). Examples of the alkylamines which function as antirust additives or as reaction products with the above carboxylates to give amides and the like are represented by primary amines such as laurylamine, coconut-amine, n-tridecylamine, myristylamine, n-pentadecylamine, palmitylamine, n-heptadecylamine, stearylamine, n-nonadecylamine, n-eicosylamine, n-heneicosylamine, n-docosylamine, n-tricosylamine, n-pentacosylamine, oleylamine, beef tallow-amine, hydrogenated beef tallow-amine and soy bean-amine. Examples of the secondary amines include dilaurylamine, di-coconut-amine, di-n-tridecylamine, dimyristylamine, di-n-pentadecylamine, dipalmitylamine, di-n-pentadecylamine, distearylamine, di-n-nonadecylamine, di-n-eicosylamine, di-n-heneicosylamine, di-n-docosylamine, di-n-tricosylamine, di-n-pentacosyl-amine, dioleylamine, di-beef tallow-amine, di-hydrogenated beef tallow-amine and di-soy bean-amine. Examples of the aforementioned N-alkylpolyalkyenediamines include: ethylenediamines such as laurylethylenediamine, coconut ethylenediamine, n-tridecylethylenediamine-, myristylethylenediamine, n-pentadecylethylenediamine, palmitylethylenediamine, n-heptadecylethylenediamine, stearylethylenediamine, n-nonadecylethylenediamine, n-eicosylethylenediamine, n-heneicosylethylenediamine, n-docosylethylendiamine, n-tricosylethylenediamine, n-pentacosylethylenediamine, oleylethylenediamine, beef tallow-ethylenediamine, hydrogenated beef tallow-ethylenediamine and soy bean-ethylenediamine; propylenediamines such as laurylpropylenediamine, coconut propylenediamine, n-tridecylpropylenediamine, myristylpropylenediamine, n-pentadecylpropylenediamine, palmitylpropylenediamine, n-heptadecylpropylenediamine, stearylpropylenediamine, n-nonadecylpropylenediamine, n-eicosylpropylenediamine, n-heneicosylpropylenediamine, n-docosylpropylendiamine, n-tricosylpropylenediamine, n-pentacosylpropylenediamine, diethylene triamine (DETA) or triethylene tetramine (TETA), oleylpropylenediamine, beef tallow-propylenediamine, hydrogenated beef tallow-propylenediamine and soy bean-propylenediamine; butylenediamines such as laurylbutylenediamine, coconut butylenediamine, n-tridecylbutylenediamine-, myristylbutylenediamine, n-pentadecylbutylenediamine, stearylbutylenediamine, n-eicosylbutylenediamine, n-heneicosylbutylenedia-mine, n-docosylbutylendiamine, n-tricosylbutylenediamine, n-pentacosylbutylenediamine, oleylbutylenediamine, beef tallow-butylenediamine, hydrogenated beef tallow-butylenediamine and soy bean butylenediamine; and pentylenediamines such as laurylpentylenediamine, coconut pentylenediamine, myristylpentylenediamin-e, palmitylpentylenediamine, stearylpentylenediamine, oleylpentylenediamine, beef tallow-pentylenediamine, hydrogenated beef tallow-pentylenediamine and soy bean pentylenediamine.

Demulsifying agents include alkoxylated phenols and phenol-formaldehyde resins and synthetic alkylaryl sulfonates such as metallic dinonylnaphthalene sulfonates. A demulsifying agent is a predominant amount of a water-soluble polyoxyalkylene glycol having a pre-selected molecular weight of any value in the range of between about 450 and 5000 or more. An especially preferred family of water soluble polyoxyalkylene glycol useful in the compositions of the present invention may also be one produced from alkoxylation of n-butanol with a mixture of alkylene oxides to form a random alkoxylated product.

Functional fluids according to the invention possess a pour point of less than about −20 degree C., and exhibit compatibility with a wide range of anti-wear additive and extreme pressure additives. The formulations according to the invention also are devoid of fatigue failure that is normally expected by those of ordinary skill in the art when dealing with polar lubricant base stocks.

Polyoxyalkylene glycols useful in the present invention may be produced by a well-known process for preparing polyalkylene oxide having hydroxyl end-groups by subjecting an alcohol or a glycol ether and one or more alkylene oxide monomers such as ethylene oxide, butylene oxide, or propylene oxide to form block copolymers in addition polymerization while employing a strong base such as potassium hydroxide as a catalyst. In such process, the polymerization is commonly carried out under a catalytic concentration of 0.3 to 1.0% by mole of potassium hydroxide to the monomer(s) and at high temperature, as 100 degrees C. to 160 degrees C. It is well known fact that the potassium hydroxide being a catalyst is for the most part bonded to the chain-end of the produced polyalkylene oxide in a form of alkoxide in the polymer solution so obtained.

An especially preferred family of soluble polyoxyalkylene glycol useful in the compositions of the present invention may also be one produced from alkoxylation of n-butanol with a mixture of alkylene oxides to form a random alkoxylated product.

Foam inhibitors include polymers of alkyl methacrylate especially useful poly alkyl acrylate polymers where alkyl is generally understood to be methyl, ethyl propyl, isopropyl, butyl, or iso butyl and polymers of dimethylsilicone which form materials called dimethylsiloxane polymers in the viscosity range of 100 cSt to 100,000 cSt. Other additives are defoamers, such as silicone polymers which have been post reacted with various carbon containing moieties, are the most widely used defoamers. Organic polymers are sometimes used as defoamers although much higher concentrations are required.

Metal deactivating compounds/Corrosion inhibitors include 2,5-dimercapto-1,3,4-thiadiazoles and derivatives thereof, mercaptobenzothiazoles, alkyltriazoles and benzotriazoles. Examples of dibasic acids useful as anti-corrosion agents, other than sebacic acids, which may be used in the present invention, are adipic acid, azelaic acid, dodecanedioic acid, 3-methyladipic acid, 3-nitrophthalic acid, 1,10-decanedicarboxylic acid, and fumaric acid. The anti-corrosion combination is a straight or branch-chained, saturated or unsaturated monocarboxylic acid or ester thereof which may optionally be sulphurised in an amount up to 35% by weight. Preferably the acid is a C sub 4 to C sub 22 straight chain unsaturated monocarboxylic acid. The preferred concentration of this additive is from 0.001% to 0.35% by weight of the total lubricant composition. The preferred monocarboxylic acid is sulphurised oleic acid. However, other suitable materials are oleic acid itself; valeric acid and erucic acid. A component of the anti-corrosion combination is a triazole as previously defined. The triazole should be used at a concentration from 0.005% to 0.25% by weight of the total composition. The preferred triazole is tolylotriazole which may be included in the compositions of the invention include triazoles, thiazoles and certain diamine compounds which are useful as metal deactivators or metal passivators. Examples include triazole, benzotriazole and substituted benzotriazoles such as alkyl substituted derivatives. The alkyl substituent generally contains up to 1.5 carbon atoms, preferably up to 8 carbon atoms. The triazoles may contain other substituents on the aromatic ring such as halogens, nitro, amino, mercapto, etc. Examples of suitable compounds are benzotriazole and the tolyltriazoles, ethylbenzotriazoles, hexylbenzotriazoles, octylbenzotriazoles, chlorobenzotriazoles and nitrobenzotriazoles. Benzotriazole and tolyltriazole are particularly preferred. A straight or branched chain saturated or unsaturated monocarboxylic acid which is optionally sulphurised in an amount which may be up to 35% by weight; or an ester of such an acid; and a triazole or alkyl derivatives thereof, or short chain alkyl of up to 5 carbon atoms; n is zero or an integer between 1 and 3 inclusive; and is hydrogen, morpholino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole.

Alkyl is straight or branched chain and is for example methyl, ethyl, n-propyl, iso-propyl, n-butyl, sec-butyl, n-pentyl, n-hexyl, n-heptyl, n-octyl, 2-ethylhexyl, n-nonyl, n-decyl, n-dodecyl, n-tetradecyl, n-hexadecyl, n-octadecyl or n-eicosyl.

Alkenyl is straight or branched chain and is for example prop-2-enyl, but-2-enyl, 2-methyl-prop-2-enyl, pent-2-enyl, hexa-2,4-dienyl, dec-10-enyl or eicos-2-enyl.

Cylcoalkyl is for example cyclopentyl, cyclohexyl, cyclooctyl, cyclodecyl, adamantyl or cyclododecyl.

Aralkyl is for example benzyl, 2-phenylethyl, benzhydryl or naphthylmethyl. Aryl is for example phenyl or naphthyl.

The heterocyclic group is for example a morpholine, pyrrolidine, piperidine or a perhydroazepine ring.

Alkylene moieties include for example methylene, ethylene, 1:2- or 1:3-propylene, 1:4-butylene, 1:6-hexylene, 1:8-octylene, 1:10-decylene and 1:12-dodecylene.

Arylene moieties include for example phenylene and naphthylene. 1-(or 4)-(dimethylaminomethyl)triazole, 1-(or 4)-(diethylaminomethyl)triazole, 1-(or 4)-(di-isopropylaminomethyl)triazole, 1-(or 4)-(di-n-butylaminomethyl)triazole, 1-(or 4)-(di-n-hexylaminomethyl)triazole, 1-(or 4)-(di-isooctylaminomethyl)triazole, 1-(or 4)-(di-(2-ethylhexyl)aminomethyl)triazole, 1-(or 4)-(di-n-decylaminomethyl)triazole, 1-(or 4)-(di-n-dodecylaminomethyl)triazole, 1-(or 4)-(di-n-octadecylaminomethyl)triazole, 1-(or 4)-(di-n-eicosylaminomethyl)triazole, 1-(or 4)-[di-(prop-2'-enyl) aminomethyl]triazole, 1-(or 4)-[di-(but-2'-enyl) aminomethyl]triazole, 1-(or 4)-[di-(eicos-2'-enyl) aminomethyl]triazole, 1-(or 4)-(di-cyclohexylaminomethyl) triazole, 1-(or 4)-(di-benzylaminomethyl)triazole, 1-(or 4)-(di-phenylaminomethyl)triazole, 1-(or 4)-(4'-morpholinomethyl)triazole, 1-(or 4)-(1'-pyrrolidinomethyl) triazole, 1-(or 4)-(1'-piperidinomethyl)triazole, 1-(or 4)-(1'-perhydroroazepinomethyl)triazole, 1-(or 4)-(2',2"-dihydroxyethyl)aminomethyl]triazole, 1-(or 4)-(dibutoxypropyl-aminomethyl)triazole, 1-(or 4)-(dibutylthiopropyl-aminomethyl)triazole, 1-(or 4)-(dibutylaminopropyl-aminomethyl)triazole, 1-(or -4)-(1-methanomine)-N,N-bis(2-ethylhexyl)-methyl benzotriazole, N,N-bis-(1- or 4-triazolylmethyl) laurylamine, N,N-bis-(1- or 4-triazolylmethyl)oleylamine, N,N-bis-(1- or 4-triazolylmethyl)ethanolamine and N,N,N',N'-tetra(1- or 4-triazolylmethyl)ethylene diamine.

Also, dihydrocarbyl dithiophosphate metal salts where the metal is aluminum, lead, tin, manganese, molybdenum, antimony, cobalt, nickel, zinc or copper, but most often zinc. Sulfur- and/or phosphorus- and/or halogen-containing compounds, such as sulfurized olefins and vegetable oils, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, di(2-ethylhexyl)-aminomethyltolyltriazole, derivatives of 2,5-dimercapto-1,3,4-thiadiazole, ethyl ((bisisopropyloxyphosphinothioyl)-thio)

propionate, triphenyl thiophosphate (triphenyl phosphorothioate), tris(alkylphenyl) phosphorothioates and mixtures thereof (for example tris(isononylphenyl) phosphorothioate), diphenylmononylphenyl phosphorothioate, isobutylphenyl diphenyl phosphorothioate, the dodecylamine salt of 3-hydroxy-1,3-thiaphosphetan 3-oxide, trithiophosphoric acid 5,5,5-tris(isooctyl 2-acetate), derivatives of 2-mercaptobenzothiazole, such as 1-(N,N-bis(2-ethylhexyl) aminomethyl)-2-m-ercapto-1H-1,3-benzothiazole or ethoxycarbonyl 5-octyldithiocarbamate.

The metal deactivating agents which can be used in the lubricating oil a composition of the present invention include benzotriazole and the 4-alkylbenzotriazoles such as 4-methylbenzotriazole and 4-ethylbenzotriazole; 5-alkylbenzotriazoles such as 5-methylbenzotriazole, 5-ethylbenzotriazole; 1-alkylbenzotriazoles such as 1-dioctylauainomethyl-2,3-benzotriazole; benzotriazole derivatives such as the 1-alkyltolutriazoles, for example, 1-dioctylaminomethyl-2,3-t-olutriazole; benzimidazole and benzimidazole derivatives such as 2-(alkyldithio)-benzimidazoles, for example, such as 2-(octyldithio)-benzimidazole, 2-(decyldithio)benzimidazole and 2-(dodecyldithio)-benzimidazole; 2-(alkyldithio)-toluimidazoles such as 2-(octyldithio)-toluimidazole, 2-(decyldithio)-toluimidazole and 2-(dodecyldithio)-toluimidazole; indazole and indazole derivatives of toluimidazoles such as 4-alkylindazole, 5-alkylindazole; benzothiazole, 2-mercaptobenzothiazole derivatives (manufactured by the Chiyoda Kagaku Co. under the trade designation "Thiolite B-3100") and 2-(alkyldithio)benzothiazoles such as 2-(hexyldithio)benzothiazole and 2-(octyldithio)benzothiazole; 2-(alkyl-dithio)toluthiazoles such as 2-(benzyldithio)toluthiazole and 2-(octyldithio)toluthiazole, 2-(N,N-dialkyldithiocarbamyl)benzothiazoles such as 2-(N,N-diethyldithiocarbamyl)benzothiazole, 2-(N,N-dibutyldithiocarbamyl)benzotriazole and 2-N,N-dihexyl-dithiocarbamyl)benzotriazole; benzothiazole derivatives of 2-(N,N-dialkyldithiocarbamyl)toluthiazoles such as 2-(N,N-diethyldithiocarbamyl)toluthiazole, 2-(N,N-dibutyldithiocarbamyl)toluthiazole, 2-(N,N-dihexyl-dithiocarbamyl)-toluthiazole; 2-(alkyldithio)benzoxazoles such as 2-(octyldithio)benzoxazo-le, 2-(decyldithio)-benzoxazole and 2-(dodecyldithio)benzoxazole; benzoxazole derivatives of 2-(alkyldithio)toluoxazoles such as 2-(octyldithio)toluoxazole, 2-(decyldithio)toluoxazole, 2-(dodecyldithio)toluoxazole; 2,5-bis(alkyldithio)-1,3,4-thiadiazoles such as 2,5-bis(heptyldithio)-1,3,4-thiadiazole, 2,5-bis(nonyldithio)-1,-3,4-thiadiazole, 2,5-bis(dodecyldithio)-1,3,4-thiadiazole and 2,5-bis-(octadecyldithio)-1,3,4-thiadiazole; 2,5-bis(N,N-dialkyl-dithiocarbamyl)-1,3,4-thiadiazoles such as 2,5-bis(N,N-diethyldithiocarbamyl)-1,3,-4-thiadiazole, 2,5-bis(N,N-dibutyldithiocarbamyl)-1,3,4-thiadiazole and 2,5-bis(N,N-dioctyldithiocarbamyl)1,3,4-thiadiazole; thiadiazole derivatives of 2-N,N-dialkyldithiocarbamyl-5-mercapto-1,3,4-thiadiazoles such as 2-N,N-dibutyldithiocarbamyl-5-mercapto-1,3,4-thiadiazole and 2-N,N-dioctyldithiocarbamyl-5-mercapto-1,3,4-thiadiazole, and triazole derivatives of 1-alkyl-2,4-triazoles such as 1-dioctylaminomethyl-2,4-triazole or concentrates and/or mixtures thereof.

Anti-wear agents/Extreme pressure agent/Friction Reducer: zinc alkyldithiophosphates, aryl phosphates and phosphites, sulfur-containing esters, phosphosulfur compounds, and metal or ash-free dithiocarbamates.

A phosphate ester or salt may be a monohydrocarbyl, dihydrocarbyl or a trihydrocarbyl phosphate, wherein each hydrocarbyl group is saturated. In one embodiment, each hydrocarbyl group independently contains from about 8 to about 30, or from about 12 up to about 28, or from about 14 up to about 24, or from about 14 up to about 18 carbons atoms. In one embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

A phosphate ester or salt is a phosphorus acid ester prepared by reacting one or more phosphorus acid or anhydride with a saturated alcohol. The phosphorus acid or anhydride is generally an inorganic phosphorus reagent, such as phosphorus pentoxide, phosphorus trioxide, phosphorus tetroxide, phosphorous acid, phosphoric acid, phosphorus halide, lower phosphorus esters, or a phosphorus sulfide, including phosphorus pentasulfide, and the like. Lower phosphorus acid esters generally contain from 1 to about 7 carbon atoms in each ester group. Alcohols used to prepare the phosphorus acid esters or salts. Examples of commercially available alcohols and alcohol mixtures include Alfol 1218 (a mixture of synthetic, primary, straight-chain alcohols containing 12 to 18 carbon atoms); Alfol 20+ alcohols (mixtures of C 18-C 28 primary alcohols having mostly C20 alcohols as determined by GLC (gas-liquid-chromatography)); and Alfol22+ alcohols (C 18-C 28 primary alcohols containing primarily C 22 alcohols). Alfol alcohols are available from Continental Oil Company. Another example of a commercially available alcohol mixture is Adol 60 (about 75% by weight of a straight chain C 22 primary alcohol, about 15% of a C 20 primary alcohol and about 8% of C 18 and C 24 alcohols). The Adol alcohols are marketed by Ashland Chemical.

A variety of mixtures of monohydric fatty alcohols derived from naturally occurring triglycerides and ranging in chain length from C 8 to C 18 are available from Procter & Gamble Company. These mixtures contain various amounts of fatty alcohols containing 12, 14, 16, or 18 carbon atoms. For example, CO-1214 is a fatty alcohol mixture containing 0.5% of C 10 alcohol, 66.0% of C 12 alcohol, 26.0% of C 14 alcohol and 6.5% of C 16 alcohol.

Another group of commercially available mixtures include the "Neodol" products available from Shell Chemical Co. For example, Neodol 23 is a mixture of C 12 and C 13 alcohols; Neodol 25 is a mixture of C 12 to C 15 alcohols; and Neodol 45 is a mixture of C 14 to C 15 linear alcohols. The phosphate contains from about 14 to about 18 carbon atoms in each hydrocarbyl group. The hydrocarbyl groups of the phosphate are generally derived from a mixture of fatty alcohols having from about 14 up to about 18 carbon atoms. The hydrocarbyl phosphate may also be derived from a fatty vicinal diol. Fatty vicinal diols include those available from Ashland Oil under the general trade designation Adol 114 and Adol 158. The former is derived from a straight chain alpha olefin fraction of C 11-C 14, and the latter is derived from a C 15-C 18 fraction.

The phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435.

The monoamines generally contain a hydrocarbyl group which contains from 1 to about 30 carbon atoms, or from 1 to about 12, or from 1 to about 6. Examples of primary monoamines useful in the present invention include methylamine, ethylamine, propylamine, butylamine, cyclopentylamine, cyclohexylamine, octylamine, dodecylamine, allylamine, cocoamine, stearylamine, and laurylamine Examples of secondary monoamines include dimethylamine, diethylamine, dipropylamine, dibutylamine, dicyclopentylamine, dicyclohexylamine, methylbutylamine, ethylhexylamine, etc.

An amine is a fatty (C.sub.8-30) amine which includes n-octylamine, n-decylamine, n-dodecylamine, n-tetradecylamine, n-hexadecylamine, n-octadecylamine, oleyamine, etc. Also useful fatty amines include commercially available fatty amines such as "Armeen" amines (products available from Akzo Chemicals, Chicago, Ill.), such Armeen C, Armeen O, Armeen OL, Armeen T, Armeen HT, Armeen S and Armeen S D, wherein the letter designation relates to the fatty group, such as coco, oleyl, tallow, or stearyl groups.

Other useful amines include primary ether amines, such as those represented by the formula, R"(OR') x NH 2, wherein R' is a divalent alkylene group having about 2 to about 6 carbon atoms; x is a number from one to about 150, or from about one to about five, or one; and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear C 16), SURFAM P17B (tridecyloxypropylamine). The carbon chain lengths (i.e., C 14, etc.) of the SURFAMS described above and used hereinafter are approximate and include the oxygen ether linkage.

An amine is a tertiary-aliphatic primary amine. Generally, the aliphatic group, preferably an alkyl group, contains from about 4 to about 30, or from about 6 to about 24, or from about 8 to about 22 carbon atoms. Usually the tertiary alkyl primary amines are monoamines the alkyl group is a hydrocarbyl group containing from one to about 27 carbon atoms and R 6 is a hydrocarbyl group containing from 1 to about 12 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine. Mixtures of tertiary aliphatic amines may also be used in preparing the phosphate salt. Illustrative of amine mixtures of this type are "Primene 81R" which is a mixture of C 11-C 14 tertiary alkyl primary amines and "Primene JMT" which is a similar mixture of C 18-C 22 tertiary alkyl primary amines (both are available from Rohm and Haas Company). The tertiary aliphatic primary amines and methods for their preparation are known to those of ordinary skill in the art. The tertiary aliphatic primary amine useful for the purposes of this invention and methods for their preparation are described in U.S. pat. An amine is a heterocyclic polyamine. The heterocyclic polyamines include aziridines, azetidines, azolidines, tetra- and dihydropyridines, pyrroles, indoles, piperidines, imidazoles, di- and tetra-hydroimidazoles, piperazines, isoindoles, purines, morpholines, thiomorpholines, N-aminoalkylmorpholines, N-aminoalkylthiomorpholines, N-aminoalkyl-piperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

The metal salts of the phosphorus acid esters are prepared by the reaction of a metal base with the acidic phosphorus ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably, the metal is magnesium, calcium, manganese or zinc. Examples of metal compounds which may be reacted with the phosphorus acid include zinc hydroxide, zinc oxide, copper hydroxide, copper oxide, etc.

Lubricating compositions also may include a fatty imidazoline or a reaction product of a fatty carboxylic acid and at least one polyamine. The fatty imidazoline has fatty substituents containing from 8 to about 30, or from about 12 to about 24 carbon atoms. The substituent may be saturated or unsaturated for example, heptadeceneyl derived olyel groups, preferably saturated. In one aspect, the fatty imidazoline may be prepared by reacting a fatty carboxylic acid with a polyalkylenepolyamine, such as those discussed above. The fatty carboxylic acids are generally mixtures of straight and branched chain fatty carboxylic acids containing about 8 to about 30 carbon atoms, or from about 12 to about 24, or from about 16 to about 18. Carboxylic acids include the polycarboxylic acids or carboxylic acids or anhydrides having from 2 to about 4 carbonyl groups, preferably 2. The polycarboxylic acids include succinic acids and anhydrides and Diels-Alder reaction products of unsaturated monocarboxylic acids with unsaturated carboxylic acids (such as acrylic, methacrylic, maleic, fumaric, crotonic and itaconic acids). Preferably, the fatty carboxylic acids are fatty monocarboxylic acids, having from about 8 to about 30, preferably about 12 to about 24 carbon atoms, such as octanoic, oleic, stearic, linoleic, dodecanoic, and tall oil acids, preferably stearic acid. The fatty carboxylic acid is reacted with at least one polyamine. The polyamines may be aliphatic, cycloaliphatic, heterocyclic or aromatic. Examples of the polyamines include alkylene polyamines and heterocyclic polyamines.

Hydroxyalkyl groups are to be understood as meaning, for example, monoethanolamine, diethanolamine or triethanolamine, and the term amine also includes diamine. The amine used for the neutralization depends on the phosphoric esters used. The EP additive according to the invention has the following advantages: It very high effectiveness when used in low concentrations and it is free of chlorine. For the neutralization of the phosphoric esters, the latter are taken and the corresponding amine slowly added with stirring. The resulting heat of neutralization is removed by cooling. The EP additive according to the invention can be incorporated into the respective base liquid with the aid of fatty substances (e.g. tall oil fatty acid, oleic acid, etc.) as solubilizers. The base liquids used are napthenic or paraffinic base oils, synthetic oils (e.g. polyglycols, mixed polyglycols), polyolefins, carboxylic esters, etc.

The composition comprises at least one phosphorus containing extreme pressure additive. Examples of such additives are amine phosphate extreme pressure additives such as that known under the trade name IRGALUBE 349 and/or triphenyl phosphorothionate extreme pressure/anti-wear additives such as that known under the trade name IRGALUBE TPPT.

Such amine phosphates are suitably present in an amount of from 0.01 to 2%, preferably 0.2 to 0.6% by weight of the lubricant composition while such phosphorothionates are suitably present in an amount of from 0.01 to 3%, preferably 0.5 to 1.5% by weight of the lubricant composition. A mixture of an amine phosphate and phosphorothionate is employed.

At least one straight and/or branched chain saturated or unsaturated monocarboxylic acid which is optionally sulphurised in an amount which may be up to 35% by weight; and/or an ester of such an acid. At least one triazole or alkyl derivatives thereof, or short chain alkyl of up to 5 carbon atoms and is hydrogen, morphilino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole; and The neutral organic phosphate which forms a component of the formulation may be present in an amount of 0.01 to 4%, preferably 1.5 to 2.5% by weight of the composition. The above amine phosphates and any of the aforementioned benzo- or tolyltriazoles can be mixed together to form a single component capable of delivering antiwear performance. The neutral organic phosphate is also a conventional ingredient of lubricating compositions and any such neutral organic phosphate falling within the formula as previously defined may be employed.

Phosphates for use in the present invention include phosphates, acid phosphates, phosphites and acid phosphites. The phosphates include triaryl phosphates, trialkyl phosphates, trialkylaryl phosphates, triarylalkyl phosphates and trialkenyl phosphates. As specific examples of these, referred to are triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate, and trioleyl phosphate. The acid phosphates include, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate. The phosphites include, for example, triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenylisodecyl phosphite, tristearyl phosphite, and trioleyl phosphite.

The acid phosphites include, for example, dibutyl hydrogenphosphite, dilauryl hydrogenphosphite, dioleyl hydrogenphosphite, distearyl hydrogenphosphite, and diphenyl hydrogenphosphite.

Amines that form amine salts with such phosphates include, for example, mono-substituted amines, di-substituted amines and tri-substituted amines. Examples of the mono-substituted amines include butylamine, pentylamine, hexylamine, cyclohexylamine, octylamine, laurylamine, stearylamine, oleylamine and benzylamine; and those of the di-substituted amines include dibutylamine, dipentylamine, dihexylamine, dicyclohexylamine, dioctylamine, dilaurylamine, distearylamine, dioleylamine, dibenzylamine, stearyl monoethanolamine, decyl monoethanolamine, hexyl monopropanolamine, benzyl monoethanolamine, phenyl monoethanolamine, and tolyl monopropanolamine Examples of tri-substituted amines include tributylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine, and tripropanolamine Phosphates or their amine salts are added to the base oil in an amount of from 0.03 to 5% by weight, preferably from 0.1 to 4% by weight, relative to the total weight of the composition.

Carboxylic acids to be reacted with amines include, for example, aliphatic carboxylic acids, dicarboxylic acids (dibasic acids), and aromatic carboxylic acids. The aliphatic carboxylic acids have from 8 to 30 carbon atoms, may be saturated or unsaturated, and linear or branched. Specific examples of the aliphatic carboxylic acids include pelargonic acid, lauric acid, tridecanoic acid, myristic acid, palmitic acid, stearic acid, isostearic acid, eicosanoic acid, behenic acid, triacontanoic acid, caproleic acid, undecylenic acid, oleic acid, linolenic acid, erucic acid, and linoleic acid. Specific examples of the dicarboxylic acids include octadecylsuccinic acid, octadecenylsuccinic acid, adipic acid, azelaic acid, and sebacic acid. One example of the aromatic carboxylic acids is salicylic acid. The amines to be reacted with carboxylic acids include, for example, polyalkylenepolyamines such as diethylenetriamine, triethylenetetramine, tetraethylenepentamine, pentaethylenehexamine, hexaethyleneheptamine, heptaethyleneoctamine, dipropylenetriamine, tetrapropylenepentamine, and hexabutyleneheptamine; and alkanolamines such as monoethanolamine and diethanolamine. Of these, preferred are a combination of isostearic acid and tetraethylenepentamine, and a combination of oleic acid and diethanolamine. The reaction products of carboxylic acids and amines are added to the base oil in an amount of from 0.01 to 5% by weight, preferably from 0.03 to 3% by weight, relative to the total weight of the composition.

Important components are phosphites, thiophosphites phosphates, and thiophosphates, including mixed materials having, for instance, one or two sulfur atoms, i.e., monothio- or dithio compounds. As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

Hydrocarbon substituents, that is, aliphatic (e.g., alkyl or alkenyl), alicyclic (e.g., cycloalkyl, cycloalkenyl) substituents, and aromatic-, aliphatic-, alicyclic-substituted aromatic substituents, as well as cyclic substituents wherein the ring is completed through another portion of the molecule (e.g., two substituents together form an alicyclic radical); the substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy); and hetero-atom containing substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "hydrocarbyl group," in the context of the present invention, is also intended to encompass cyclic hydrocarbyl or hydrocarbylene groups, where two or more of the alkyl groups in the above structures together form a cyclic structure. The hydrocarbyl or hydrocarbylene groups of the present invention generally are alkyl or cycloalkyl groups which contain at least 3 carbon atoms. Preferably or optimally containing sulfur, nitrogen, or oxygen, they will contain 4 to 24, and alternatively 5 to 18 carbon atoms. In another embodiment they contain about 6, or exactly 6 carbon atoms. The hydrocarbyl groups can be tertiary or preferably primary or secondary groups; in one embodiment the component is a di(hydrocarbyl)hydrogen phosphite and each of the hydrocarbyl groups is a primary alkyl group; in another embodiment the component is a di(hydrocarbyl)hydrogen phosphite and each of the hydrocarbyl groups is a secondary alkyl group. In yet another embodiment the component is a hydrocarbylenehydrogen phosphite.

Examples of straight chain hydrocarbyl groups include methyl, ethyl, n-propyl, n-butyl, n-hexyl, n-octyl, n-decyl, n-dodecyl, n-tetradecyl, stearyl, n-hexadecyl, n-octadecyl, oleyl, and cetyl. Examples of branched-chain hydrocarbon groups include isopropyl, isobutyl, secondary butyl, tertiary butyl, neopentyl, 2-ethylhexyl, and 2,6-dimethylheptyl. Examples of cyclic groups include cyclobutyl, cyclopentyl, methylcyclopentyl, cyclohexyl, methylcyclohexyl, cycloheptyl, and cyclooctyl. A few examples of aromatic hydrocarbyl groups and mixed aromatic-aliphatic hydrocarbyl groups include phenyl, methylphenyl, tolyl, and naphthyl.

The R groups can also comprise a mixture of hydrocarbyl groups derived from commercial alcohols. Examples of some monohydric alcohols and alcohol mixtures include the commercially available "Alfol™" alcohols marketed by Continental Oil Corporation. Alfol™ 810, for instance, is a mixture containing alcohols consisting essentially of straight chain, primary alcohols having from 8 to 12 carbon atoms. Alfol™ 12 is a mixture of mostly C12 fatty alcohols; Alfol™ 22+ comprises C 18-28 primary alcohols having mostly C 22 alcohols, and so on. Various mixtures of monohydric fatty alcohols derived from naturally occurring triglycerides and ranging in chain length from C 8 to C 18 are available from Procter & Gamble Company. "Neodol™" alcohols are available from Shell Chemical Co., where, for instance, Neodol™ 25 is a mixture of C 12 to C 15 alcohols.

Specific examples of some of the phosphites and thiophosphites within the scope of the invention include phosphorous acid, mono-, di-, or tri-thiophosphorous acid, mono-, di-, or tri-propyl phosphite or mono-, di-, or tri-thiophosphite; mono-, di-, or tri-butyl phosphite or mono-, di-, or tri-thiophosphite; mono-, di-, or tri-amyl phosphite or mono-, di-, or tri-thiophosphite; mono-, di-, or tri-hexyl phosphite or mono-, di-, or tri-thiophosphite; mono-, di-, or tri-phenyl phosphite or mono-, di-, or tri-thiophosphite; mono-, di-, or tri-tolyl phosphite or mono-, di-, or tri-thiophosphite; mono-, di-, or tri-cresyl phosphite or mono-, di-, or tri-thiophosphite; dibutyl phenyl phosphite or mono-, di-, or tri-phosphite, amyl dicresyl phosphite or mono-, di-, or tri-thiophosphite, and any of the above with substituted groups, such as chlorophenyl or chlorobutyl.

Specific examples of the phosphates and thiophosphates within the scope of the invention include phosphoric acid, mono-, di-, or tri-thiophosphoric acid, mono-, di-, or tri-propyl phosphate or mono-, di-, or tri-thiophosphate; mono-, di-, or tri-butyl phosphate or mono-, di-, or tri-thiophosphate; mono-, di-, or tri-amyl phosphate or mono-, di-, or tri-thiophosphate; mono-, di-, or tri-hexyl phosphate or mono-, di-, or tri-thiophosphate; mono-, di-, or tri-phenyl phosphate or mono-, di-, or tri-thiophosphate; mono-, di-, or tritolyl phosphate or mono-, di-, or trithiophosphate; mono-, di-, or tri-cresyl phosphate or mono-, di-, or tri-thiophosphate; dibutyl phenyl phosphate or mono-, di-, or tri-phosphate, amyl dicresyl phosphate or mono-, di-, or tri-thiophosphate, and any of the above with substituted groups, such as chlorophenyl or chlorobutyl.

The phosphorus compounds of the present invention are prepared by well known reactions. One route the reaction of an alcohol or a phenol with phosphorus trichloride or by a transesterification reaction. Alcohols and phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. Thiophosphates can be prepared by the reaction of phosphites with elemental sulfur. In any case, the reaction can be conducted with moderate heating. Moreover, various phosphorus esters can be prepared by reaction using other phosphorus esters as starting materials. Thus, medium chain (C9 to C22) phosphorus esters have been prepared by reaction of dimethylphosphite with a mixture of medium-chain alcohols by means of a thermal transesterification or an acid- or base-catalyzed transesterification; see for example U.S. Pat. No. 4,652,416. Most such materials are also commercially available; for instance, triphenyl phosphite is available from Albright and Wilson as Duraphos TPP™; di-n-butyl hydrogen phosphite from Albright and Wilson as Duraphos DBHP™; and triphenylthiophosphate from Ciba Specialty Chemicals as Irgalube TPPT™.

The other major component of the present composition is a hydrocarbon having ethylenic unsaturation. This would normally be described as an olefin or a diene, triene, polyene, and so on, depending on the number of ethylenic unsaturations present. Preferably the olefin is mono unsaturated, that is, containing only a single ethylenic double bond per molecule. The olefin can be a cyclic or a linear olefin. If a linear olefin, it can be an internal olefin or an alpha-olefin. The olefin can also contain aromatic unsaturation, i.e., one or more aromatic rings, provided that it also contains ethylenic (non-aromatic) unsaturation.

The olefin normally will contain 6 to 30 carbon atoms. Olefins having significantly fewer than 6 carbon atoms tend to be volatile liquids or gases which are not normally suitable for formulation into a composition suitable as an antiwear lubricant. Preferably the olefin will contain 6 to 18 or 6 to 12 carbon atoms, and alternatively 6 or 8 carbon atoms.

Among suitable olefins are alkyl-substituted cyclopentenes, hexenes, cyclohexene, alkyl-substituted cyclohexenes, heptenes, cycloheptenes, alkyl-substituted cycloheptenes, octenes including diisobutylene, cyclooctenes, alkyl-substituted cyclooctenes, nonenes, decenes, undecenes, dodecenes including propylene tetramer, tridecenes, tetradecenes, pentadecenes, hexadecenes, heptadecenes, octadecenes, cyclooctadiene, norbornene, dicyclopentadiene, squalene, diphenylacetylene, and styrene. Highly preferred olefins are cyclohexene and 1-octene.

Examples of esters of the dialkylphosphorodithioic acids include esters obtained by reaction of the dialkyl phosphorodithioic acid with an alpha, beta-unsaturated carboxylic acid (e.g., methyl acrylate) and, optionally an alkylene oxide such as propylene oxide.

Generally, the compositions of the present invention will contain varying amounts of one or more of the above-identified metal dithiophosphates such as from about 0.01 to about 2% by weight, and more generally from about 0.01 to about 1% by weight, based on the weight of the total composition.

The hydrocarbyl in the dithiophosphate may be alkyl, cycloalkyl, aralkyl or alkaryl groups, or a substantially hydrocarbon group of similar structure. Illustrative alkyl groups include isopropyl, isobutyl, n-butyl, sec-butyl, the various amyl groups, n-hexyl, methylisobutyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

The phosphorodithioic acids from which the metal salts useful in this invention are prepared are well known. Examples of dihydrocarbylphosphorodithioic acids and metal salts, and processes for preparing such acids and salts are found in, for example U.S. Pat. Nos. 4,263,150; 4,289,635; 4,308,154; and 4,417,990. These patents are hereby incorporated by reference.

The phosphorodithioic acids are prepared by the reaction of a phosphorus sulfide with an alcohol or phenol or mixtures of alcohols. A typical reaction involves four moles of the alcohol or phenol and one mole of phosphorus pentasulfide, and may be carried out within the temperature range from about 50° C. to about 200° C. Thus, the preparation of O,O-di-n-hexyl phosphorodithioic acid involves the reaction of a mole of phosphorus pentasulfide with four moles of n-hexyl alcohol at about 100° C. for about two hours. Hydrogen sulfide is liberated and the residue is the desired acid. The preparation of the metal salts of these acids may be effected by reaction with metal compounds as well known in the art.

The metal salts of dihydrocarbyldithiophosphates which are useful in this invention include those salts containing Group I metals, Group II metals, aluminum, lead, tin, molybdenum, manganese, cobalt, and nickel. The Group II metals, aluminum, tin, iron, cobalt, lead, molybdenum, manganese, nickel and copper are among the preferred metals. Zinc and copper are especially useful metals. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butylate, cobalt hydroxide, nickel hydroxide, nickel carbonate, and the like.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate with potentially improved performance properties.

Especially useful metal phosphorodithloates can be prepared from phosphorodithloic acids which in turn are prepared by the reaction of phosphorus pentasulfide with mixtures of alcohols. In addition, the use of such mixtures enables the utilization of less expensive alcohols which individually may not yield oil-soluble phosphorodithioic acids. Thus a mixture of isopropyl and hexylalcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 2-methyl-4-pentanol; isopropanol and sec-butyl alcohol; isopropanol and isooctyl alcohol; and the like.

Organic triesters of phosphorus acids are also employed in lubricants. Typical esters include triarylphosphates, trialkyl phosphates, neutral alkylaryl phosphates, alkoxyalkyl phosphates, triaryl phosphite, trialkylphosphite, neutral alkyl aryl phosphites, neutral phosphonate esters and neutral phosphine oxide esters. In one embodiment, the long chain dialkyl phosphonate esters are used. More preferentially, the dimethyl-, diethyl-, and dipropyl-oleyl phosphonates can be used. Neutral acids of phosphorus acids are the triesters rather than an acid (HO—P) or a salt of an acid.

Any C4 to C8 alkyl or higher phosphate ester may be employed in the invention. For example, tributyl phosphate (TBP) and tri isooctal phosphate (TOF) can be used. The specific triphosphate ester or combination of esters can easily be selected by one skilled in the art to adjust the density, viscosity etc. of the formulated fluid. Mixed esters, such as dibutyl octyl phosphate or the like may be employed rather than a mixture of two or more trialkyl phosphates.

A trialkyl phosphate is often useful to adjust the specific gravity of the formulation, but it is desirable that the specific trialkyl phosphate be a liquid at low temperatures. Consequently, a mixed ester containing at least one partially alkylated with a C3 to C4 alkyl group is very desirable, for example, 4-isopropylphenyl diphenyl phosphate or 3-butylphenyl diphenyl phosphate. Even more desirable is a triaryl phosphate produced by partially alkylating phenol with butylene or propylene to form a mixed phenol which is then reacted with phosphorus oxychloride as taught in U.S. Pat. No. 3,576,923.

Any mixed triaryl phosphate (TAP) esters may be used as cresyl diphenyl phosphate, tricresyl phosphate, mixed xylyl cresyl phosphates, lower alkylphenyl/phenyl phosphates, such as mixed isopropylphenyl/phenyl phosphates, t-butylphenyl phenyl phosphates. These esters are used extensively as plasticizers, functional fluids, gasoline additives, flame-retardant additives and the like.

An Extreme pressure agent, sulfur-based extreme pressure agents, such as sulfides, sulfoxides, sulfones, thiophosphinates, thiocarbonates, sulfurized fats and oils, sulfurized olefins and the like; phosphorus-based extreme pressure agents, such as phosphoric acid esters (e.g., tricresyl phosphate (TCP) and the like), phosphorous acid esters, phosphoric acid ester amine salts, phosphorous acid ester amine salts, and the like; halogen-based extreme pressure agents, such as chlorinated hydrocarbons and the like; organometallic extreme pressure agents, such as thiophosphoric acid salts (e.g., zinc dithiophosphate (ZnDTP) and the like) and thiocarbamic acid salts; and the like can be used. As the anti-wear agent, organomolybdenum compounds such as molybdenum dithiophosphate (MoDTP), molybdenum dithiocarbamate (MoDTC) and the like; organoboric compounds such as alkylmercaptyl borate and the like; solid lubricant anti-wear agents such as graphite, molybdenum disulfide, antimony sulfide, boron compounds, polytetrafluoroethylene and the like; and the like can be used.

The phosphoric acid ester, thiophosphoric acid ester, and amine salt thereof functions to enhance the lubricating performances, and can be selected from known compounds conventionally employed as extreme pressure agents. Generally employed are phosphoric acid esters, a thiophosphoric acid ester, or an amine salt thereof which has an alkyl group, an alkenyl group, an alkylaryl group, or an aralkyl group, any of which contains approximately 3 to 30 carbon atoms.

Examples of the phosphoric acid esters include aliphatic phosphoric acid esters such as triisopropyl phosphate, tributyl phosphate, ethyl dibutyl phosphate, trihexyl phosphate, tri-2-ethylhexyl phosphate, trilauryl phosphate, tristearyl phosphate, and trioleyl phosphate; and aromatic phosphoric acid esters such as benzyl phenyl phosphate, allyl diphenyl phosphate, triphenyl phosphate, tricresyl phosphate, ethyl diphenyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutylphenyl phenyl phosphate, and tributylphenyl phosphate. Preferably, the phosphoric acid ester is a trialkylphenyl phosphate.

Examples of the thiophosphoric acid esters include aliphatic thiophosphoric acid esters such as triisopropyl thiophosphate, tributyl thiophosphate, ethyl dibutyl thiophosphate, trihexyl thiophosphate, tri-2-ethylhexyl thiophosphate, trilauryl thiophosphate, tristearyl thiophosphate, and trioleyl thiophosphate; and aromatic thiophosphoric acid esters such as benzyl phenyl thiophosphate, allyl diphenyl thiophosphate, triphenyl thiophosphate, tricresyl thiophosphate, ethyl diphenyl thiophosphate, cresyl diphenyl thiophosphate, dicresyl phenyl thiophosphate, ethylphenyl diphenyl thiophosphate, diethylphenyl phenyl thiophosphate, propylphenyl diphenyl thiophosphate, dipropylphenyl phenyl thiophosphate, triethylphenyl thiophosphate, tripropylphenyl thiophosphate, butylphenyl diphenyl thiophosphate, dibutylphenyl phenyl thiophosphate, and tributylphenyl thiophosphate. Preferably, the thiophosphoric acid ester is a trialkylphenyl thiophosphate.

Also employable are amine salts of the above-mentioned phosphates and thiophosphates. Amine salts of acidic alkyl or aryl esters of the phosphoric acid and thiophosphoric acid are also employable. Preferably, the amine salt is an amine salt of trialkylphenyl phosphate or an amine salt of alkyl phosphate.

One or any combination of the compounds selected from the group consisting of a phosphoric acid ester, a thiophosphoric acid ester, and an amine salt thereof may be used.

The phosphorus acid ester and/or its amine salt function to enhance the lubricating performances, and can be selected from known compounds conventionally employed as extreme pressure agents. Generally employed are a phosphorus acid ester or an amine salt thereof which has an alkyl group, an alkenyl group, an alkylaryl group, or an aralkyl group, any of which contains approximately 3 to 30 carbon atoms.

Examples of the phosphorus acid esters include aliphatic phosphorus acid esters such as triisopropyl phosphite, tributyl phosphite, ethyl dibutyl phosphite, trihexyl phosphite, tri-2-ethylhexylphosphite, trilauryl phosphite, tristearyl phosphite, and trioleyl phosphite; and aromatic phosphorus acid esters such as benzyl phenyl phosphite, allyl diphenylphosphite, triphenyl phosphite, tricresyl phosphite, ethyl diphenyl phosphite, tributyl phosphite, ethyl dibutyl phosphite, cresyl diphenyl phosphite, dicresyl phenyl phosphite, ethylphenyl diphenyl phosphite, diethylphenyl phenyl phosphite, propylphenyl diphenyl phosphite, dipropylphenyl phenyl phosphite, triethylphenyl phosphite, tripropylphenyl phosphite, butylphenyl diphenyl phosphite, dibutylphenyl phenyl phosphite, and tributylphenyl phosphite. Also favorably employed are dilauryl phosphite, dioleyl phosphite, dialkyl phosphites, and diphenyl phosphite. Preferably, the phosphorus acid ester is a dialkyl phosphite or a trialkyl phosphite.

The phosphate salt may be derived from a polyamine. The polyamines include alkoxylated diamines, fatty polyamine diamines, alkylenepolyamines, hydroxy containing polyamines, condensed polyamines arylpolyamines, and heterocyclic polyamines. Commercially available examples of alkoxylated diamines include those amine where y in the above formula is one. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylene diamines, propane diamines (1,2, or 1,3), and polyamine analogs of the above. Suitable commercial fatty polyamines are Duomeen C. (N-coco-1,3-diaminopropane), Duomeen S(N-soya-1,3-diaminopropane), Duomeen T (N-tallow-1,3-diaminopropane), and Duomeen 0 (N-oleyl-1,3-diaminopropane). "Duomeens" are commercially available from Armak Chemical Co., Chicago, Ill.

Such alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylenediamine, triethylenetetramine, tris-(2-aminoethyl)amine, propylenediamine, trimethylenediamine, tripropylenetetramine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment the polyamine is an ethylenepolyamine. Such polyamines are described in detail under the heading Ethylene Amines in Kirk Othmer's "Encyclopedia of Chemical Technology", 2d Edition, Vol. 7, pages 22-37, Interscience Publishers, New York (1965). Ethylenepolyamines are often a complex mixture of polyalkylenepolyamines including cyclic condensation products.

Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200° C. A typical sample of such ethylene polyamine bottoms obtained from the Dow Chemical Company of Freeport, Tex. designated "E-100". These alkylenepolyamine bottoms include cyclic condensation products such as piperazine and higher analogs of diethylenetriamine, triethylenetetramine and the like. These alkylenepolyamine bottoms can be reacted solely with the acylating agent or they can be used with other amines, polyamines, or mixtures thereof. Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. (See carboxylic ester dispersants.) In one embodiment, the hydroxy compounds are polyhydric amines Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl)amino methane, 2-amino-2-methyl-1,3-propanediol, N,N,N',N'-tetrakis (2-hydroxypropyl)ethylenediamine, and N,N,N',N'-tetrakis (2-hydroxyethyl)ethylenediamine, preferably tris (hydroxymethyl)aminomethane (THAM).

Polyamines which react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms".

Examples of extreme pressure additives include sulphur-based extreme pressure additives such as dialkyl sulphides, dibenzyl sulphide, dialkyl polysulphides, dibenzyl disulphide, alkyl mercaptans, dibenzothiophene and 2,2'-dithiobis (benzothiazole); phosphorus-based extreme pressure additives such as trialkyl phosphates, triaryl phosphates, trialkyl phosphonates, trialkyl phosphites, triaryl phosphites and dialkylhydrozine phosphites, and phosphorus- and sulphur-based extreme pressure additives such as zinc dialkyldithiophosphates, dialkylthiophosphoric acid, trialkyl thiophosphate esters, acidic thiophosphate esters and trialkyl trithiophosphates. These extreme pressure additives can be used individually or in the form of mixtures, conveniently in an amount within the range from 0.1 to 2 parts by weight, per 100 parts by weight of the base oil.

All the above can be performance enhanced using a variety of cobase stocks, AN, AB, ADPO, ADPS, ADPM, and/or a variety of mono-basic, di-basic, and tribasic esters in conjunction with low sulfur, low aromatic, low iodine number, low bromine number, high analine point, isoparafin.

EXAMPLES

We formulated seven inventive gear oil blends for comparison against two commercially available gear oils as shown in Table 4. All the inventive blends contained two base stocks and contained the same standard gear oil additive package except as noted below.

The first blend (A) comprises a metallocene catalyzed PAO base stock with a viscosity of 620 cSt, Kv100° C. The second base stock contained a PAO with a viscosity of 4 cSt, Kv100° C. The blend also includes alkylated naphthalene and phthalate ester along with a gear oil additive pack.

The second blend (B) comprises a metallocene catalyzed PAO base stock with a viscosity of 620 cSt, Kv100° C. The second PAO base stock with a viscosity of 4 cSt, Kv100° C. The blend also includes a polyol ester along with a gear oil additive pack.

The third blend (C) comprises a metallocene catalyzed PAO with a viscosity of 620 cSt, Kv100° C. and a low viscosity PAO with a viscosity of 40 cSt, Kv100° C. The blend also includes a polyol ester along with a gear oil additive pack.

The fourth blend (D) comprises a metallocene catalyzed PAO with a viscosity of 450 cSt, Kv100° C. and a low viscosity PAO with a viscosity of 4 cSt, Kv100° C. The blend also includes alkylated naphthalene and phthalate ester along with a gear oil additive pack.

The fifth blend (E) comprises a metallocene catalyzed PAO with a viscosity of 300 cSt, Kv100° C. and a low viscosity PAO with a viscosity of 4 cSt, Kv100° C. The blend also includes alkylated naphthalene and phthalate ester along with a gear oil additive pack.

The sixth blend (F) comprises a metallocene catalyzed PAO with a viscosity of 150 cSt, Kv100° C. and a low viscosity PAO with a viscosity of 4 cSt, Kv100° C. The blend also includes a TMP ester instead of adipate ester along with a gear oil additive pack.

The seventh blend (G) comprises a metallocene catalyzed PAO with a viscosity of 135 cSt, Kv100° C. and a low viscosity PAO with a viscosity of 4 cSt, Kv100° C. The blend also includes a TMP ester instead of adipate ester along with a gear oil additive pack.

Table 4 shows the formulations of the seven novel blends relative to the two commercial synthetic products which serve as the benchmarks of performance as shown in Table 4. The benefit is most pronounced in the when compared to synthetic gear oil A which is a metallocene PAO gear oil with some alkylated naphtaleline. The three novel formulations provide comparable SWG efficiency and operating temperature performance to Polyalkylene glycols ("PAGs") oils but retain the benefits of PAO oils.

PAGs have some excellent properties but also have some inherent poor properties. The excellent properties of PAGs include viscosity index, foam and air control, efficiency and oxidative stability. The poor properties include water tolerance, rust control and compatibility. The novel formulations in Table 4 provide all around excellent properties including comparable performance to PAGs for excellent viscosity index, foam and air control, efficiency and oxidative stability while also providing good water tolerance, compatibility and rust control.

TABLE 4

| ISO VG 460 | EXPERIMENTAL | | | | | | | COMMERCIAL | |
|---|---|---|---|---|---|---|---|---|---|
| Kv100° C. = 50-60 cSt | A | B | C | D | E | F | G | Conventional PAO-based lubricant | Conventional PAG-based lubricant |
| mHVI PAO 620 cSt | 45.7 | 51.7 | 19.7 | | | | | | |
| mHVI PAO 450 cSt | | | | 54.7 | | | | | |
| mHVI PAO 300 cSt | | | | | 60.7 | | | | |
| mHVI PAO 150 cSt | | | | | | 76.7 | | | |
| mHVI PAO 135 cSt | | | | | | | 78.7 | | |
| 40 cSt PAO | | | 70 | | | | | | |
| 4 cSt PAO | 41 | 38 | | 35 | 29 | 13 | 11 | | |

TABLE 4-continued

| ISO VG 460 | EXPERIMENTAL | | | | | | | COMMERCIAL | |
|---|---|---|---|---|---|---|---|---|---|
| Cobase stock & Additives | 13.3 | 10.3 | 10.3 | 10.3 | 10.3 | 10.3 | 10.3 | | |
| Worm Gear Ave Sump Temp ° F. | 152 | 157 | 159 | 169 | 168 | 158 | 158 | 175 | 150 |
| Worm Gear Ave Efficiency | 81.1 | 79.9 | 79.3 | 77.6 | 77.8 | 78.3 | 78.3 | 76.7 | 80.5 |
| ASTM D3427 75° C. Time to 0.2% Air (min) | 5.2 | 5.7 | 5.9 | 5.4 | 7.1 | 4.4 | 4.4 | 22.4 | 21 |
| ASTM D97 Pour Point ° C. | −42 | −42 | −39 | −48 | −39 | −42 | −42 | −42 | −33 |

While the examples have been to gear oils, these examples are not intended to be limiting. The novel formulations provides improved properties of all lubricating uses including but not limited to industrial, engine and hydraulic oils.

Figure 3:
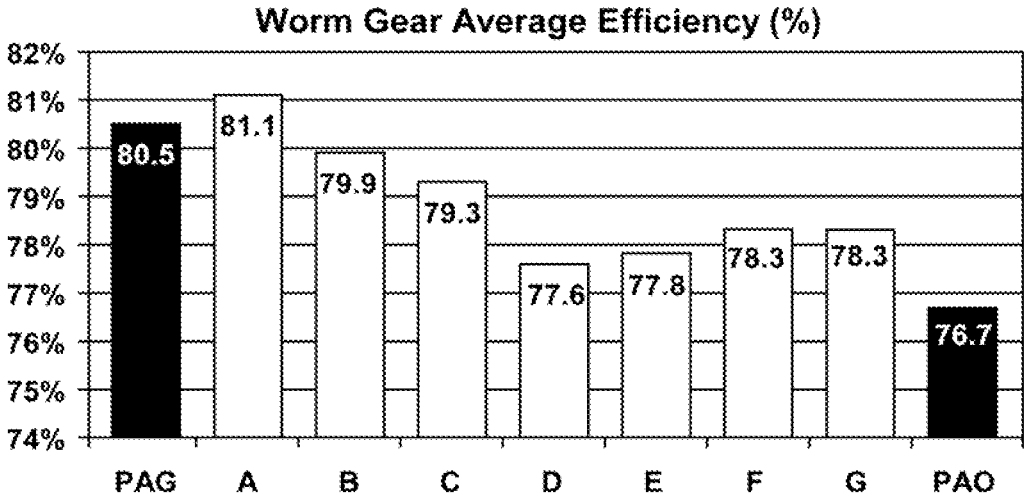
FIG. 3 is a graph showing the improved SWG efficiency of gear oils formulated with high viscosity metallocene catalyzed PAO compared to the commercially available prior art PAO.

The Worm Gear Average Efficiency data from Table 4 is shown in FIG. 3. FIG. 3 shows the seven experimental extreme-modal formulations A, B, C, D, E, F, and G relative to the current commercially available synthetic PAO and PAG gear oils. Formulation blends A, B, C, D, E, F, and G all have equally very small amounts of antiwear and defoamant only for short gear testing. Indeed, the worm gear efficiencies of seven experimental formulations rival that of the commercially available PAGs. Blends F and G also demonstrate excellent worm gear efficiencies with blends comprising metalleocene catalyzed PAO base stock below 300 cSt, Kv100° C. with the addition of TMP ester.

Figure 4:
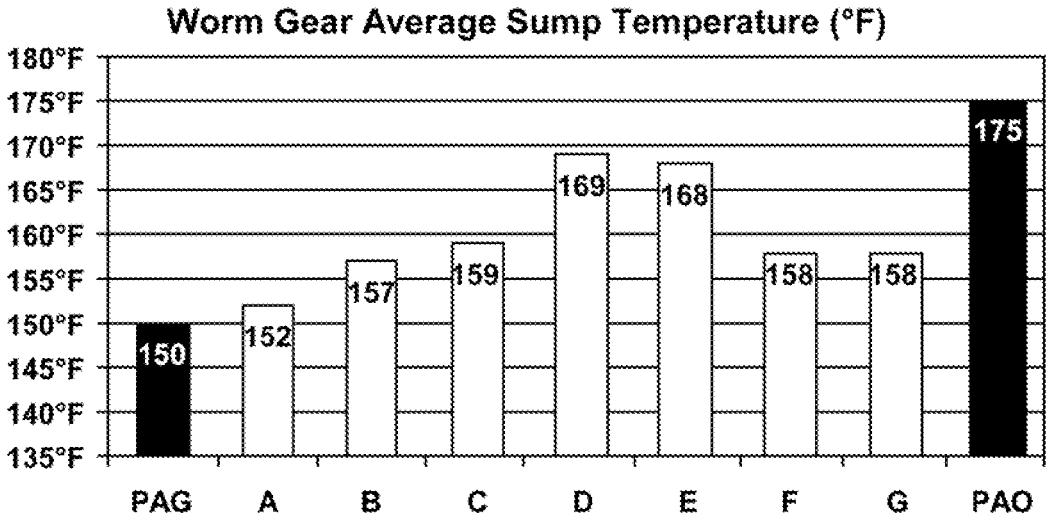
FIG. 4 is a graph showing the improved SWG operating temperature of gear oils formulated with high viscosity metallocene catalyzed PAO compared to the commercially available prior art PAO.

The data from Table 4 is shown in FIG. 4. FIG. 4 is a graph illustrating the improved operational temperature benefits profile of A, B, C, D, E, F, and G of high viscosity metallocene-catalyzed base stocks in bi-modal blend as compared to the profile of a high viscosity conventional PAO base stock in a blend with a low viscosity base stock. And a PAG based lubricant. Blends F and G demonstrate excellent operational temperature properties with blends comprising metalleocene-catalyzed PAO base stock below 300 cSt, Kv100° C. with the addition of TMP ester.

Figure 5:
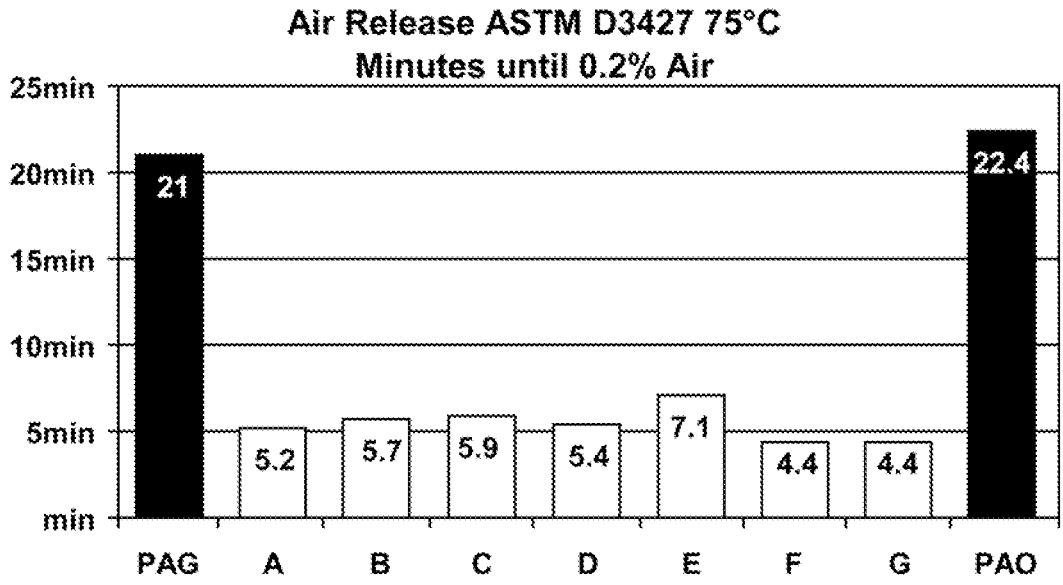
FIG. 5 is a graph showing the improved air release of gear oils formulated with high viscosity metallocene catalyzed PAO compared to the commercially available gear oils.

The metallocene based base stocks in a bi-modal formula further provide favorable air release benefits. FIG. 5 illustrates the improved air release of the novel formulations in Table 4 when compare to commercially available gear oils including typical PAO and PAG blends. Blends F and G also demonstrate superior air release properties with blends comprising metalleocene catalyzed PAO base stock below 300 cSt, Kv100° C. with the addition of TMP ester.

Figure 6:
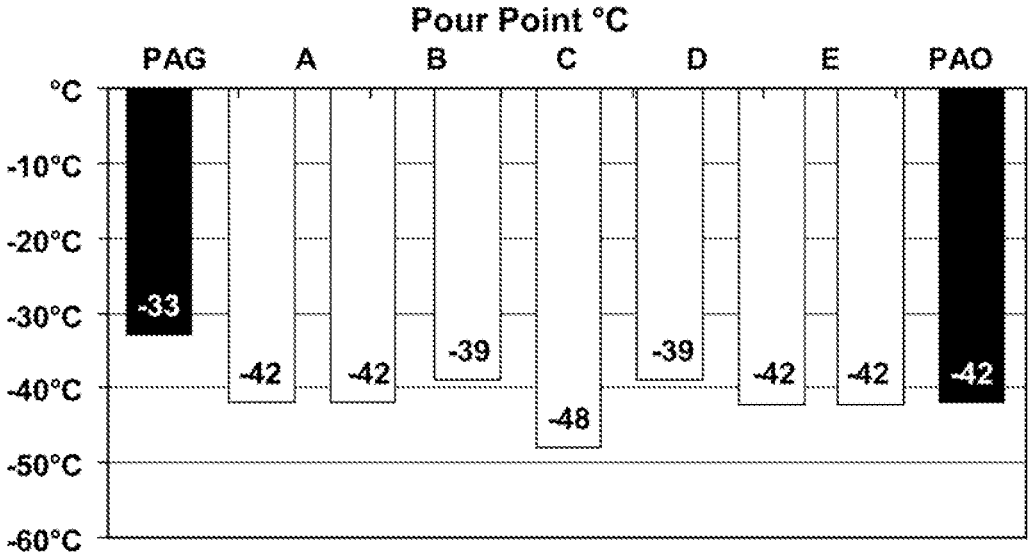
FIG. 6 is a graph showing the similar pour points of gear oils formulated with high viscosity metallocene catalyzed PAO compared to the commercially available gear oils.

In addition, the metallocene based bases stocks in a bi-modal formula provides favorable low temperature benefits including favorable pour points compared to PAGs. Favorable pour points permit better oil pumpability and better equipment startup at low temperatures. For pour point testing, ASTM D97 is most often utilized. In this method, oil is slowly cooled at a specific rate, and examined at 3° C. intervals for flow characteristics. The lowest temperature where movement is observed is the pour point. FIG. 6 illustrates the improved pour points of the novel formulations in Table 4 when compared to commercially available PAG gear oil blends as well as equivalent performance when compared to typical PAO gear oil blends. Blends F and G also demonstrate excellent pour points results with blends comprising metalleocene catalyzed PAO base stock below 300 cSt, Kv100° C. with the addition of TMP ester. Blends F and G achieved an ASTM D3427 75° C. time to 0.2% Air of less than 5 minutes which was not achieved in any other blend.

In addition to the above examples, there are other base stocks that give favorable performance when combined with high viscosity metallocene catalyzed base stocks of greater than 300 cSt, Kv100° C. These base stocks include but are not limited to GTL, Group III, Group II, PIB, Group V base stocks, including alkylnaphthalenes, alkylbenzenes, polyalkylene glycols and esters including polyol esters, trimellitic esters, aromatic esters, dibasic esters and monobasic esters. In all the above cases, some portion of Group I base stock can be added to achieve suitable viscosity and to impart solvency/dispersancy and other property typical to Group I base stocks.

In addition, based on the disclosure herein other base stocks of widely disparate viscosities that give a "bi-modal" or "extreme-modal" blending result can also be envisioned with the benefit of the disclosure herein to deliver favorable lubricating properties. These properties include but are not limited to micropitting, air release, pour point, low temperature viscosity, pour point, shear stability, and any combination thereof. While the benefits discussed herein are primarily for the use of gear oil, the benefits would apply to all lubricants including marine, automotive, and industrial. The claims are intended to include all suitable lubricant applications.

In one embodiment, no VI improvers are needed due to the high inherent VI of the base stocks. This benefit permits the ability to avoid VI improvers that may adversely affect shear stability. In this embodiment, the shear stability of the lubricant should be less than 15 percent viscosity loss and even more preferably less than 10 percent viscosity loss and in the most preferred embodiment, there will be essentially no VI improvers giving rise to almost no viscosity loss.

In a preferred embodiment, no transition or alkali metals are used in the finished formulation. This finished formulation would provide enhanced hydrolytic stability.

In another embodiment, another benefit of the improved base stocks properties is the ability to use less additives. In a preferred embodiment, the base stock combination provides the ability to use additive treat rates less than 10 percent and more preferably less than 5 percent.

In an additional embodiment, the extreme model blends can be used to provide superior air release at lower temperature. Table 5 below shows the comparative data for several mineral ISO VG 32 Turbine oils (T01, T02 etc), a Gp IV PAO product and our extreme-modal invention blended with low viscosity 4 cSt PAO with Chromium 150 cST (Candidate 1) and metallocene 150 cSt (Candidate 2). These data points show a unexpected benefit in low temperature air release for the extreme modal blends, very high VI and excellent low temperature properties.

TABLE 5

| Examples | T01 | T02 | T03 | T04 | T05 | Candidate 1 | Candidate 2 |
|---|---|---|---|---|---|---|---|
| Product Type | Gp II | Gp II | Gp III | GP III (similar to GTL) | Gp IV | Extreme Modal | Extreme Modal |
| KV at 40 C, cst | 31.64 | 34.23 | 31.01 | 30.8 | 30.37 | 32.78 | 33.65 |
| KV at 100 C, cst | 5.405 | 5.716 | 5.759 | 6.062 | 5.698 | 6.867 | 6.874 |
| VI | 105 | 107 | 129 | 148 | 131 | 176 | 170 |
| D3427 Air Release at 50 C. | 2.22 | 2.92 | 1.76 | 1.82 | 1.5 | 1.13 | 1.12 |
| D3427 Air Release at 25 C. | 9.92 | 15.02 | 4.12 | 4.22 | 3.12 | 0.62 | 1.02 |
| D97 Pour pt, C. | −27 | −18 | −30 | −27 | −54 | <−54 | — |
| KV at −20° C. | 2750 | no flow at test temp | 1777 | 1518 | 1146 | 881 | 957.31 |
| D2983 Brookfield Viscosity | | | | | | | |
| Vis (mPA · s) −20 C. | 2490 | 743000 | 1240 | 1010 | 990 | 770 | 1120 |
| Vis (mPA · s) −20 F. | 22400 | 1000000 | | 3930 | 2360 | 1660 | 1950 |

Additional data was generated which confirms the low temperature air release benefit at 25° C. for the extreme modal blends. All these blends were prepare using 1.0% of a commercial rust inhibitor and oxidation additive package from a competitor that further confirms that the improvement observed is derived from the base stocks. The extreme model blends provide superior low temperature air release properties. This invention allows a formulation to give a D3427 air release 25° C. of less than 3, more preferably less than 2 and most preferably less than 1.5

TABLE 6

| Examples | 1 | 2 | 3 | 4 |
|---|---|---|---|---|
| Additive Pkg. at 1.0% wt | Rust & Oxidation Inhibitor Package | | | |
| Base Stock | PAO4/ m150 | PAO4/ Cr150 | GP III | GP II |
| KV at 40 C., cst | 33.08 | 32.21 | 32.2 | 31.89 |
| KV at 100 C., cst | 6.767 | 6.768 | 5.944 | 5.407 |
| VI | 168 | 175 | 131 | 103 |
| D3427 Air Release at 50 C. | 1.52 | 0.42 | 1.62 | 2.02 |
| D3427 Air Release at 25 C. | 0.52 | 0.52 | 4.22 | 5.95 |

What is claimed is:

1. A lubricating oil formulation prepared from a blend of components comprised of:

from 19.7 wt % to 78.7 wt % of a metallocene catalyzed PAO having a viscosity of at least 135 cSt, Kv 100° C. and a $CH_3/CH_2$ branch ratio less than 0.19, based on total weight of the blend components of the formulation;

from 11 wt % to 70 wt % of a PAO having a viscosity of not greater than 40 cSt, Kv 100° C., based on total weight of the blend components of the formulation; and from 10.3 wt % to 13.3 wt % of a combination of at least one Group V basestock selected from the group consisting of alkylnaphthalenes, alkylbenzenes, polyalkylene glycols and esters and a gear oil additive pack, based on total weight of the blend components of the formulation;

wherein the sum of the metallocene catalyzed PAO having a viscosity of at least 135 cSt, the PAO having a viscosity of not greater than 40 cSt, and the combination of at least one Group V basestock and a gear oil additive pack is about 100 wt %;

wherein the lubrication oil formulation exhibits an air release time to 0.2% air of not greater than 7.1 minutes, according to ASTM D3427-03 at 75° C.

2. The lubricating oil formulation of claim 1, wherein the metallocene catalyzed PAO having a viscosity of at least 135 cSt, Kv 100° C., has a MWD of not greater than 2.35.

3. The lubricating oil formulation of claim 1, wherein the metallocene catalyzed PAO having a viscosity of at least 135 cSt, Kv 100° C., has a VI of from 180 to 306.

4. The lubricating oil formulation of claim 1, wherein the metallocene catalyzed PAO is made from a mixture of LAOs selected from $C_3$ to $C_{30}$.

5. The lubricating oil formulation of claim 1, wherein the metallocene catalyzed PAO is made from a LAO selected from $C_3$ to $C_{16}$.

6. The lubricating oil formulation of claim 1, wherein the formulation is prepared from a blend comprised of from 11 wt % to less than or equal to 41 wt % PAO having a viscosity of not greater than 4 cSt, Kv 100° C., based on total weight of the blend components of the formulation.

7. The lubricating oil formulation of claim 6, wherein the formulation is prepared from a blend comprised of from 19.7 wt % to 45.7 wt % metallocene catalyzed PAO having a viscosity of at least 135 cSt, 100° C., based on total weight of the blend components of the formulation.

8. The lubricating oil formulation of claim 1, wherein the formulation is prepared from a blend comprised of 13.3 wt. % of a combination of at least one Group V basestock and a gear oil additive pack.

9. A method of preparing a lubricating oil composition having reduced air entrainment, comprising blending together at least the following components:

from 19.7 wt to 78.7 wt % of a metallocene catalyzed PAO having a viscosity of at least 135 cSt, Kv 100° C. and a $CH_3/CH_2$ branch ratio less than 0.19, based on total weight of the blend components of the formulation;

from 11 wt % to 70 wt % of a PAO having a viscosity of not greater than 40 cSt, Kv 100° C., based on total weight of the blend components of the formulation; and from 10.3 wt % to 13.3 wt % of a combination of at least one Group V basestock selected from the group consisting of alkylnaphthalenes, alkylbenzenes, polyalkylene glycols and esters and a gear oil additive pack, based on total weight of the blend components of the formulation, wherein the sum of the metallocene catalyzed PAO having a viscosity of at least 135 cSt, the PAO having a viscosity of not greater than 40 cSt, and the combination of at least one Group V basestock and a gear oil additive pack is about 100 wt %;

wherein the lubricating oil composition exhibits an air release time to 0.2% air of not greater than 7.1 minutes, according to ASTM D3427-03 at 75° C.

10. The method of claim 9, wherein the metallocene catalyzed PAO having a viscosity of at least 135 cSt, Kv 100° C., has a MWD of not greater than 2.35.

11. The method of claim 9, wherein the metallocene catalyzed PAO having a viscosity of at least 135 cSt, KV 100° C., has a VI of from 180 to 306.

12. The method of claim 9, wherein the metallocene catalyzed PAO is made from a mixture of LAOs selected from $C_3$ to $C_{30}$.

13. The method of claim 9, wherein the metallocene catalyzed PAO is made from a LAO selected from $C_3$ to $C_{16}$.

14. The method of claim 9, wherein the formulation is prepared from a blend comprised of from 11 wt % to less than or equal to 41 wt % PAO having a viscosity of not greater than 4 cSt, Kv 100° C., based on total weight of the blend components of the formulation.

15. The method of claim 14, wherein the formulation is prepared from a blend comprised of from 19.7 wt % to 45.7 wt % metallocene catalyzed PAO having a viscosity of at least 135 cSt, Kv 100° C., based on total weight of the blend components of the formulation.

16. The method of claim 9, wherein the formulation is prepared from a blend comprised of 13.3 wt. % of a combination of at least one Group V basestock and a gear oil additive pack.

* * * * *